US009177524B2

(12) United States Patent
Ukawa

(10) Patent No.: US 9,177,524 B2
(45) Date of Patent: Nov. 3, 2015

(54) DISPLAY APPARATUS AND CONTROL METHOD THEREOF

(75) Inventor: Satoshi Ukawa, Komae (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 388 days.

(21) Appl. No.: 13/540,154

(22) Filed: Jul. 2, 2012

(65) Prior Publication Data

US 2013/0016119 A1 Jan. 17, 2013

(30) Foreign Application Priority Data

Jul. 15, 2011 (JP) ..... 2011-156564

(51) Int. Cl.
*G09G 5/00* (2006.01)

(52) U.S. Cl.
CPC ..... *G09G 5/005* (2013.01); *G09G 2320/0626* (2013.01); *G09G 2320/0693* (2013.01); *G09G 2320/08* (2013.01); *G09G 2340/02* (2013.01); *G09G 2370/022* (2013.01); *G09G 2380/08* (2013.01)

(58) Field of Classification Search
None
See application file for complete search history.

(56) References Cited

U.S. PATENT DOCUMENTS

| | | | | |
|---|---|---|---|---|
| 2001/0028341 | A1* | 10/2001 | Kitazawa | 345/156 |
| 2002/0015016 | A1 | 2/2002 | Kudo et al. | |
| 2002/0097236 | A1 | 7/2002 | Aoki et al. | |
| 2011/0122161 | A1* | 5/2011 | Lee | 345/690 |

FOREIGN PATENT DOCUMENTS

| | | |
|---|---|---|
| CN | 1813280 A | 8/2006 |
| JP | 2002-057911 | 2/2002 |
| JP | 2005-208548 A | 4/2005 |
| JP | 2005-208548 | 8/2005 |

OTHER PUBLICATIONS

The above foreign patent documents were cited in a Oct. 24, 2014 Chinese Office Action, which is enclosed with an English Translation, that issued in Chinese Patent Application No. 201210243062.2.

* cited by examiner

*Primary Examiner* — Maurice L McDowell, Jr.
*Assistant Examiner* — Raffi Isanians
(74) *Attorney, Agent, or Firm* — Cowan, Liebowitz & Latman, P.C.

(57) ABSTRACT

A display apparatus according to the present invention includes: a measuring unit that measures an image displayed on a screen; a first determining unit that determines a first display setting by executing a single unit calibration; a second determining unit that determines a second display setting by executing a link calibration; and a determining unit that determines, during display of an external input image, which is an image based on an image signal input from an external apparatus, whether or not an output setting of the external apparatus or the second display setting differs from a setting during display of a previous external input image. The second determining unit executes the link calibration when the determining unit determines that the output setting of the external apparatus or the second display setting differs from the setting during display of the previous external input image.

20 Claims, 24 Drawing Sheets

DISPLAY APPARATUS AND CONTROL METHOD THEREOF

BACKGROUND OF THE INVENTION

1. Field of the Invention

The present invention relates to a display apparatus and a control method thereof.

2. Description of the Related Art

A high definition medical monitor (a display apparatus for displaying medical images) typically displays medical images output from an external apparatus such as a PC (personal computer). It is predicted, however, that in the future highly sophisticated medical monitors on which medical images can be displayed simply by a monitor alone will be developed. It is also predicted that a portable monitor (display apparatus) will be developed as this type of medical monitor. By using this type of medical monitor, it will be possible to perform a normal reading operation using a sophisticated PC (software stored on the PC) and the monitor, and to provide explanations and the like to a patient using the monitor alone (by displaying medical images simply using the monitor). It is also predicted that this type of medical monitor will be connected to a network. Accordingly, it is predicted that a medical monitor which obtains images from the network and displays the obtained images will be developed.

In the case of a monitor such as that described above, an appearance (a display characteristic) of a displayed image must be matched to a target value. However, an image input from a PC (an external input image hereafter) may vary according to a characteristic of a graphic board provided in the PC and processing performed in the PC (image processing performed in the PC, for example). In other words, an identical image may exhibit a different display characteristic as an external input image and an image displayed by the monitor alone (a single unit display image). To solve this problem, it may be necessary to perform both calibration (link calibration hereafter) of the display characteristic of the external input image and calibration (single unit calibration hereafter) of the display characteristic of the single unit display image as display characteristic calibration.

Related art pertaining to calibration is disclosed in Japanese Patent Application Publication No. 2002-057911 and Japanese Patent Application Publication No. 2005-208548, for example.

More specifically, Japanese Patent Application Publication No. 2002-057911 discloses a technique for correcting a result of a soft calibration on the basis of a result of a device calibration. The soft calibration is performed on the basis of data obtained by reading a printing result of a printer using a scanner. The device calibration is performed automatically in the printer on the basis of a potential of a latent image formed on a photosensitive drum and a density of a toner image.

Japanese Patent Application Publication No. 2005-208548 discloses a technique in which a photometry unit provided to face a liquid crystal display unit performs photometry, whereupon calibration is performed on the basis of a difference value between a result of the photometry and a predetermined ideal value.

SUMMARY OF THE INVENTION

However, the display characteristic of the external input image may differ from the display characteristic of the single unit display image even after the monitor has performed the single unit calibration and the link calibration. For example, when a monitor (a first monitor) is disconnected from a PC (a first PC) and taken away, another user may connect another monitor (a second monitor) to the first PC and modify a setting (an output setting of the first PC) such as an image hue output by the first PC. When the first monitor and the first PC are reconnected and an image output by the first PC is displayed on the first monitor after the setting has been modified in this manner, the display characteristic of the image (external input image) displayed on the first monitor differs from the display characteristic of a single unit display image displayed on the first monitor. Further, when the PC connected to the first monitor is switched from the first PC connected during execution of the link calibration to a second PC which is different to the first PC, the display characteristic of an external input image displayed on the first monitor may differ from the display characteristic of a single unit display image displayed on the first monitor.

The present invention provides a technique with which a difference between a display characteristic of an image based on an image signal input from an external apparatus and a display characteristic of an image displayed by a monitor alone can be suppressed.

A display apparatus according to the present invention comprises:

a measuring unit that measures an image displayed on a screen;

a first determining unit that determines a first display setting by executing a single unit calibration in which a prestored first calibration image is displayed and a display setting is adjusted such that a measurement value of the first calibration image measured by the measuring unit approaches a target value;

a second determining unit that determines a second display setting by executing a link calibration in which a second calibration image based on a calibration image signal input from an external apparatus is displayed and the display setting is adjusted such that a measurement value of the second calibration image measured by the measuring unit approaches the target value; and a determining unit that determines, during display of an external input image, which is an image based on an image signal input from the external apparatus, whether or not an output setting of the external apparatus or the second display setting differs from a setting during display of a previous external input image, wherein the second determining unit executes the link calibration when the determining unit determines that the output setting of the external apparatus or the second display setting differs from the setting during display of the previous external input image.

A display apparatus control method according to the present invention comprises:

a measuring step of measuring an image displayed on a screen;

a first determining step of determining a first display setting by executing a single unit calibration in which a prestored first calibration image is displayed and a display setting is adjusted such that a measurement value of the first calibration image measured in the measuring step approaches a target value;

a second determining step of determining a second display setting by executing a link calibration in which a second calibration image based on a calibration image signal input from an external apparatus is displayed and the display setting is adjusted such that a measurement value of the second calibration image measured in the measuring step approaches the target value; and a determining step of determining, during display of an external input image, which is an image based on an image signal input from the external apparatus, whether or not an output setting of the external apparatus or the second display setting differs from a setting during display of a previous external input image, wherein the link calibration is executed in the second determining step when the output setting of the external apparatus or the second display setting is determined in the determining step to differ from the setting during display of the previous external input image.

According to the present invention, a difference between a display characteristic of an image based on an image signal input from an external apparatus and a display characteristic of an image displayed by a monitor can be suppressed.

Further features of the present invention will become apparent from the following description of exemplary embodiments with reference to the attached drawings.

DESCRIPTION OF THE EMBODIMENTS

A display apparatus and a control method thereof according to an embodiment of the present invention will be described below. The display apparatus according to this embodiment includes a measurement unit that measures an image displayed on a screen. Further, the display apparatus according to this embodiment is capable of executing a single unit calibration and a link calibration.

In the single unit calibration, a pre-stored first calibration image is displayed on the display apparatus, and a display setting is adjusted so that a measurement value of the first calibration image measured by the measurement unit approaches a target value.

In the link calibration, a second calibration image based on a calibration image signal input from an external apparatus is displayed, and the display setting is adjusted so that a measurement value of the second calibration image measured by the measurement unit approaches a target value.

A case in which the external apparatus is a PC (personal computer) will be described below, but the external apparatus is not limited to a PC and may be any apparatus that outputs an image signal to the display apparatus, for example a hard disk recorder, a Blu-ray recorder, a display apparatus capable of external output, a game machine, and so on.

Further, a case in which the calibration images are patch images will be described below, but the calibration images are not limited to patch images and may be predetermined pattern images or the like, for example.

First Embodiment

Figure 1:
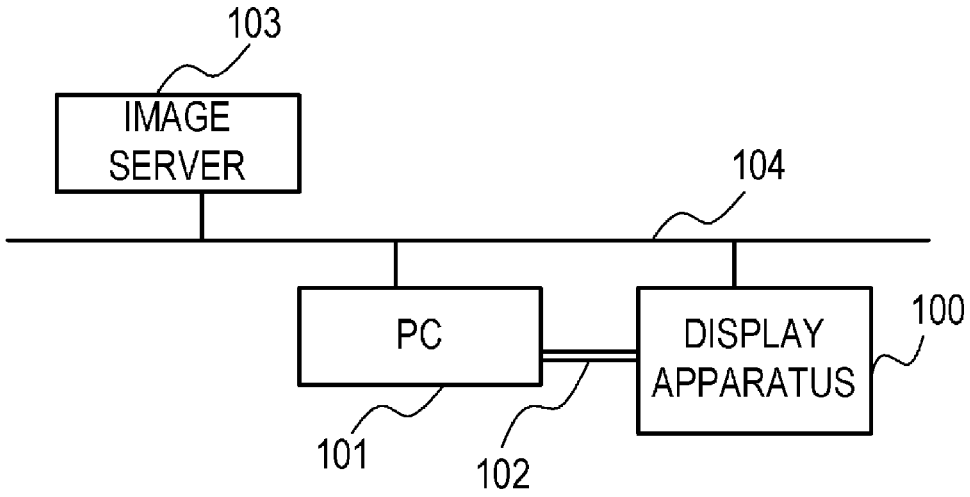
FIG. 1 shows an example of a display system according to a first embodiment.

FIG. 1 is a view showing an example of a display system according to a first embodiment of the present invention. As shown in FIG. 1, the display system according to this embodiment includes a display apparatus 100 (a monitor), a PC 101, and an image server 103.

The display apparatus 100 and the PC 101 are connected to each other using an image cable 102. The image cable 102 is a cable that complies with DVI (Registered Trademark) or Display Port (Registered Trademark) standards, for example, and is capable of transmitting image signals and signals based on DDC/CI (Display Data Channel Command Interface). Note that the PC 101 connected to the display apparatus 100 may be changed (switched). In other words, the external apparatus that outputs image signals to the display apparatus 100 may be changed.

Further, the display apparatus 100 and the PC 101 are connected to the image server 103 using a network cable 104.

The display apparatus 100 displays images based on input image signals and image files. For example, the display apparatus 100 displays an image (an external input image) based on an image signal output from the PC 101. Further, the display apparatus 100 obtains an image file from the image server 103 on the basis of a user operation, and displays an image (a single unit display image) based on the obtained image file. Note that communication between the display apparatus 100 and the image server 103 is performed in accordance with a communication protocol that complies with DICOM (Digital Imaging Communications in Medicine) standards, for example. Furthermore, the image file is an image file complying with DICOM standards, for example. More specifically, the image file is a compressed file compressed using a method such as JPEG, a non-compressed file or a lossless compressed file such as a RAW file, or the like, to which metadata complying with DICOM standards is attached. The display apparatus decodes the obtained image file and displays an image based on the image file.

Further, the display apparatus 100 transmits control signals such as a patch transmission request signal to the PC 101. The patch transmission request signal is a signal indicating a request to transmit a signal for a patch image (an external patch signal).

In response to the patch transmission request signal from the display apparatus 100, the PC 101 transmits the external patch signal and a response signal such as a signal (a patch transmission completion signal) indicating that transmission of the external patch signal is complete to the display apparatus 100. Note that when transmission of the external patch signal is complete, a patch image (an external patch image; the second calibration image) based on the external patch signal is displayed completely on the display apparatus 100. It may therefore be said that the patch transmission completion signal is a signal indicating that display of the external patch image is complete. Furthermore, the PC 101 obtains an image file from the image server 103 on the basis of a user operation. Note that communication between the PC 101 and the image server 103 is performed in accordance with a communication protocol that complies with DICOM standards, for example. The PC 101 decodes the obtained image file to generate an image signal, implements predetermined processing as required, and then outputs the generated image signal to the display apparatus 100.

Figure 2A:
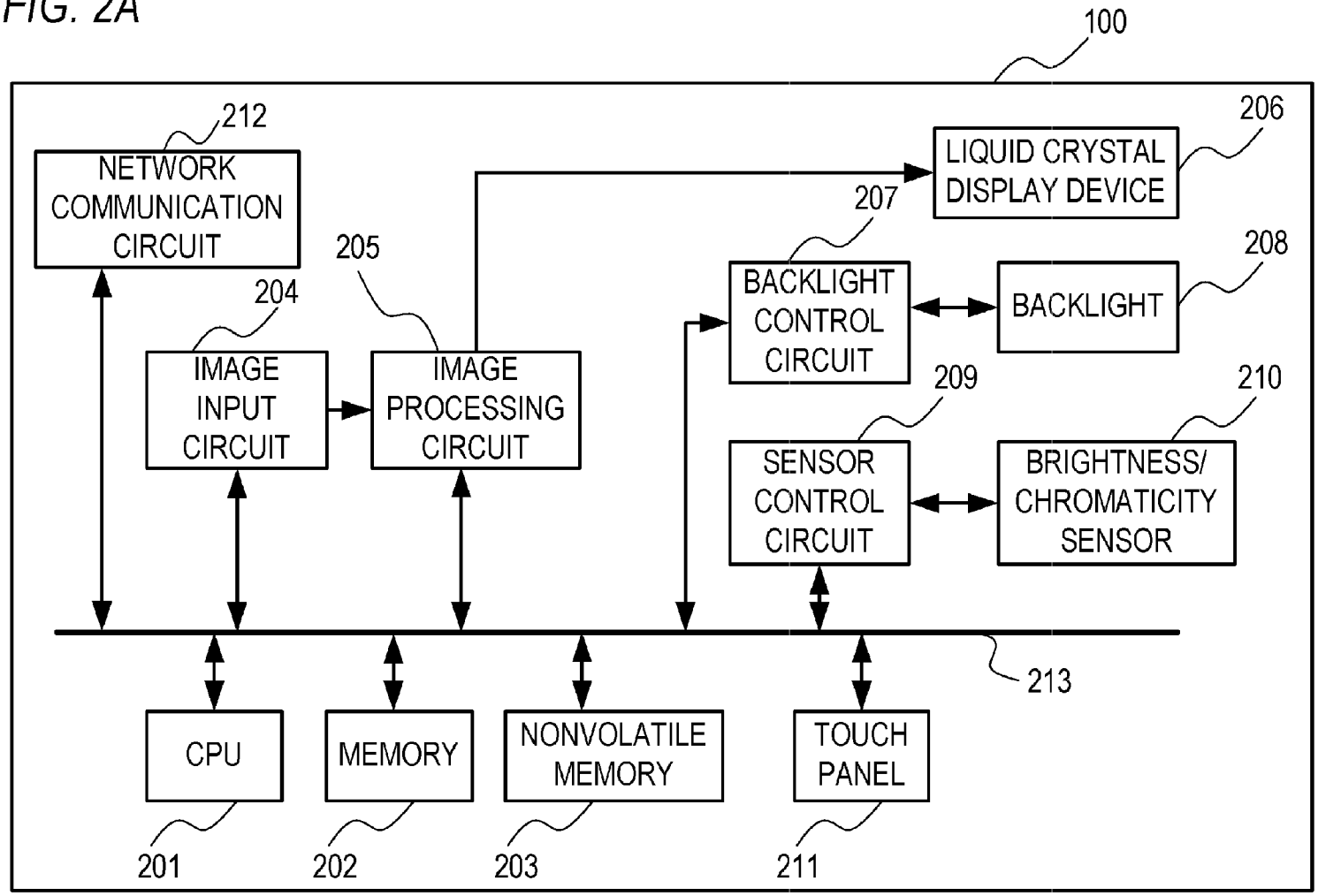
FIG. 2A shows an example of a hardware configuration of a display apparatus according to the first embodiment.
Figure 2B:
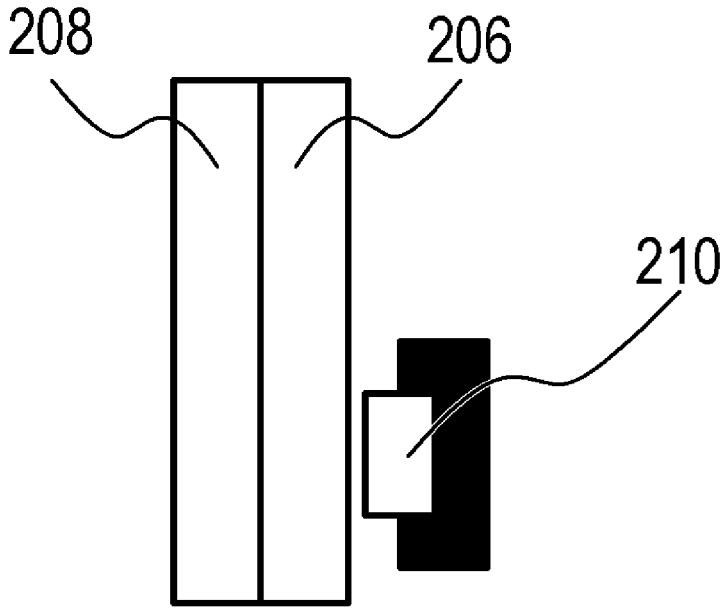
FIG. 2B shows an example of a cross-section of the display apparatus according to the first embodiment.

FIG. 2A is an example of a hardware block diagram of the display apparatus 100. FIG. 2B is an image diagram showing an example of a cross-section (a cross-section obtained from a perpendicular plane to the screen) of the vicinity of a brightness/chromaticity sensor 210 provided in the display apparatus 100.

A CPU 201 reads a program for performing various types of control from a nonvolatile memory 203, and controls respective constituent blocks connected to an internal bus 213.

For example, the CPU 201 executes a single unit calibration and a link calibration on the basis of calibration setting information recorded in the nonvolatile memory 203. The single unit calibration and the link calibration will be described in detail below. The calibration setting information is information including calibration target values (a maximum target brightness value, a target gradation curve, and so on).

Further, when the calibration setting information has been set by a user operation, the CPU 201 records (overwrites) the set calibration setting information to the nonvolatile memory 203. The user operates the display apparatus 100 using a touch panel 211, for example.

Furthermore, the CPU 201 executes an image display application (an image viewer or the like) on the basis of a user operation.

The CPU 201 also obtains an image file from the image server 103 via a network communication circuit 212 on the basis of a user operation relating to the image display application, and decodes the obtained image file to generate an image signal (a single unit display image signal). The CPU 201 then applies image processing (window level adjustment and the like) to the generated single unit display image signal as required, and outputs the signal to an image processing circuit 205. More specifically, an image signal that represents images including an image (a single unit display image) based on the single unit display image signal and an image of the image display application is generated and output to the image processing circuit 205.

A memory 202 temporarily stores data used in the processing of the CPU 201.

The nonvolatile memory 203 stores a program used by the CPU 201, a backlight emission parameter, an image quality adjustment parameter, the calibration setting information, and so on. The backlight emission parameter is a backlight brightness value or the like used during image display. The image quality adjustment parameter is a lookup table or the like used during the image processing performed by the image processing circuit 205.

Note that in this embodiment, calibration (single unit calibration) of the display characteristic of the single unit display image and calibration (link calibration) of the display characteristic of the external input image are executed individually. In this embodiment, therefore, two parameters, namely a single unit display image parameter (a first display setting) and an external input image parameter (a second display setting), are determined as the backlight emission parameter and recorded in the nonvolatile memory 203. Two parameters, namely a single unit display image parameter (a first display setting) and an external input image parameter (a second display setting), are determined as the image quality adjustment parameter and recorded in the nonvolatile memory 203. More specifically, the single unit display image parameter is determined by executing the single unit calibration, and the external input image parameter is determined by executing the link calibration.

Note that even when an identical original image file is used for the single unit display image and the external input image, predetermined processing may be implemented on the signal of the external input image in the PC, and therefore the single unit display image and the external input image do not always have matching display characteristics. It is therefore impossible in certain cases to match the respective display characteristics of the single unit display image and the external input image simply by executing the single unit calibration. Hence, in this embodiment, both the single unit calibration and the link calibration are executed.

An image input circuit 204 receives the image signal (the external input image signal (including the external patch signal)) from the PC 101 and outputs the received image signal to the image processing circuit 205. Further, the image input circuit 204 transmits a control signal to the PC 101 and outputs a response signal received from the PC 101 to the CPU 201.

The image processing circuit 205 applies image processing to the image signals received from the image input circuit 204 and the CPU 201 on the basis of the image quality adjustment parameter recorded in the nonvolatile memory 203, and outputs a resulting image-processed image signal to a liquid crystal display device 206.

The liquid crystal display device 206 is a liquid crystal panel including a plurality of liquid crystal elements, which controls transmittance values of the respective liquid crystal elements on the basis of the image signal received from the image processing circuit 205.

A backlight control circuit 207 generates a backlight control signal for controlling an emission brightness of a backlight 208 on the basis of the backlight emission parameter recorded in the nonvolatile memory 203, and outputs the generated backlight control signal.

The backlight 208 emits light on the basis of the backlight control signal received from the backlight control circuit 207.

The light from the backlight 208 is transmitted through the liquid crystal elements of the liquid crystal display device 206, and as a result, an image is displayed.

A sensor control circuit 209 outputs a sensor control signal for controlling the brightness/chromaticity sensor 210 in response to a measurement request signal received from the CPU 201, and outputs a brightness and a chromaticity measured by the brightness/chromaticity sensor 210 to the CPU 201. The measurement request signal is a signal indicating a request to measure the brightness and the chromaticity.

The brightness/chromaticity sensor 210 measures the image displayed on the screen. More specifically, the brightness/chromaticity sensor 210 starts to measure the brightness and the chromaticity upon reception of the sensor control signal from the sensor control circuit 209, and outputs measurement results to the sensor control circuit 209. As shown in FIG. 2B, for example, the brightness/chromaticity sensor 210 is provided to face the screen (the liquid crystal elements) in order to measure the on-screen brightness and chromaticity (the brightness and the chromaticity of the image (the patch image) displayed on the screen).

The touch panel 211 receives a user operation and transmits a signal corresponding to the user operation to the CPU 201.

The network communication circuit 212 transmits the image transmission request signal to the image server 103 and obtains an image file.

The respective constituent blocks of the liquid crystal display apparatus 100 perform data communication via the internal bus 213.

Figure 3:
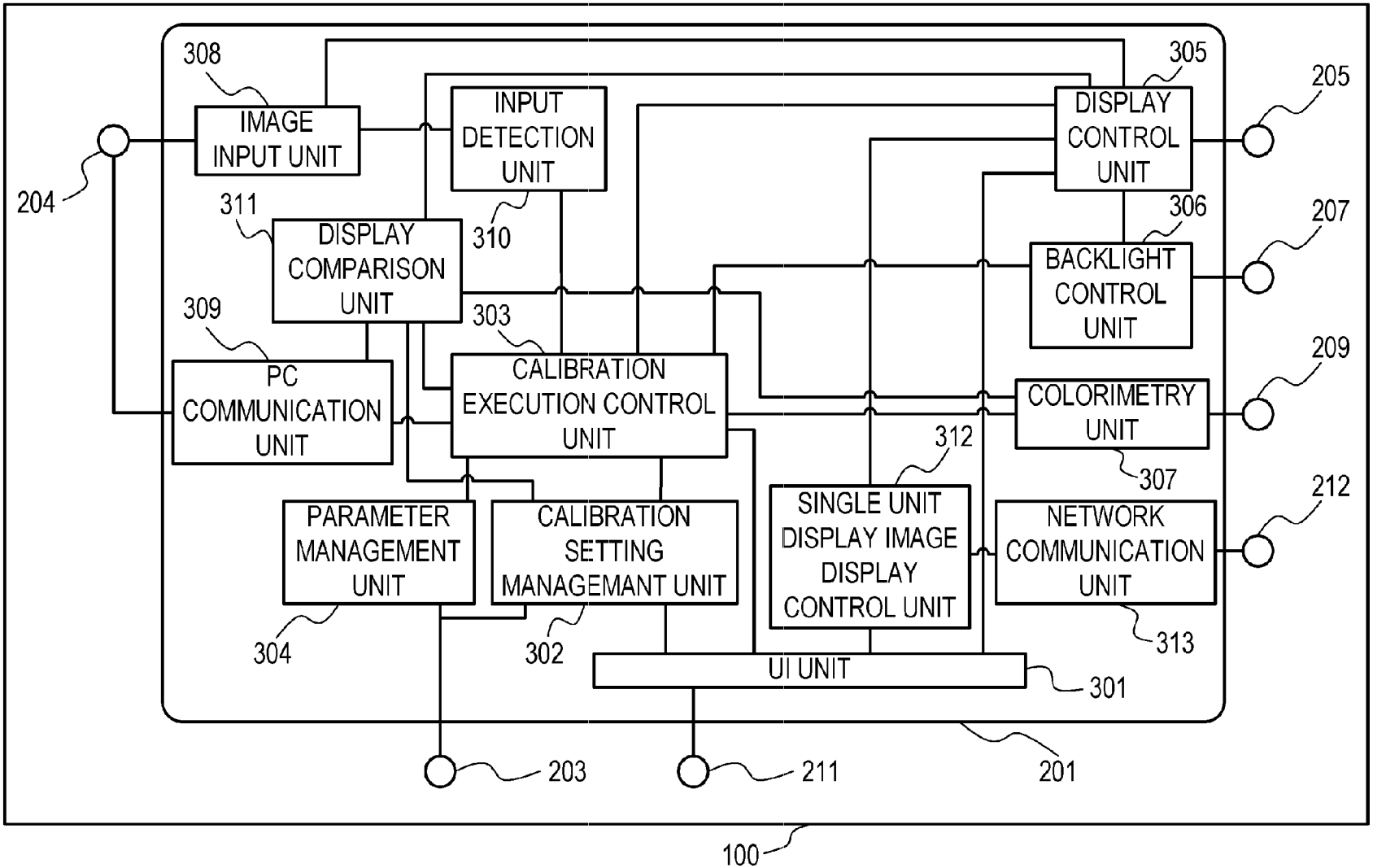
FIG. 3 shows an example of a functional configuration of the display apparatus according to the first embodiment.

FIG. 3 is a functional block diagram of the display apparatus 100.

When the user performs an operation to start setting the calibration setting information, a UI unit 301 obtains current calibration setting information from a calibration setting management unit 302. The UI unit 301 then generates and outputs a signal of a window (a setting window) for setting the calibration setting information. As a result, the setting window is displayed. When the user subsequently performs an operation to modify the calibration setting information as required and determine the calibration setting information, the UI unit 301 outputs the determined calibration setting information to the calibration setting management unit 302.

Further, when the user performs an operation to execute calibration, the UI unit 301 outputs a normal calibration execution request signal to a calibration execution control unit 303. The normal calibration execution request signal is a signal indicating a request to execute normal calibration (both the single unit calibration and the link calibration).

Furthermore, when the user performs an operation to display a single unit display image, the UI unit 301 controls a single unit display image display control unit 312 such that the single unit display image signal is output to a display control unit 305.

Further, the UI unit 301 outputs a switch request signal to the display control unit 305 in response to a user operation. The switch request signal is a signal indicating a request to switch the displayed image. In this embodiment, the displayed image is switched between an external input image based on the external input image signal from the image input unit 308 and a single unit display image based on the single unit display image signal from the single unit display image display control unit 312 in accordance with the switch request signal. Note that the displayed image may be switched to an image other than the single unit display image and the external input image in response to the switch request signal.

In response to a request from the UI unit 301, the calibration execution control unit 303, or a display comparison unit 311, the calibration setting management unit 302 reads the calibration setting information from the nonvolatile memory 203 and outputs the read calibration setting information to the transmission source of the request. The calibration setting information transmitted from the UI unit 301 is also recorded (overwritten) in the nonvolatile memory 203.

The calibration execution control unit 303 determines the single unit display image parameter by executing the single unit calibration (first determination), and determines the external input image parameter by executing the link calibration (second determination).

More specifically, the calibration execution control unit 303 obtains the calibration setting information from the calibration setting management unit 302 upon reception of the normal calibration execution request signal from the UI unit 301, and then executes the normal calibration (both the single unit calibration and the link calibration).

Further, the calibration execution control unit 303 executes the link calibration upon reception of a link calibration execution request signal from the display comparison unit 311.

When the single unit calibration is executed, the calibration execution control unit 303 outputs a pre-stored patch signal (an internal patch signal) to the display control unit 305. As a result, a patch image (an internal patch image; the first calibration image) based on the internal patch signal is displayed. At this time, the calibration execution control unit 303 outputs a measurement request signal to a colorimetry unit 307. The calibration execution control unit 303 then obtains the measurement results of the brightness/chromaticity sensor 210 (the brightness and the chromaticity of the displayed internal patch image) from the colorimetry unit 307. Next, the calibration execution control unit 303 calculates the image quality adjustment parameter and the backlight emission parameter on the basis of the obtained brightness and chromaticity, and outputs the calculated parameters to the display control unit 305, the backlight control unit 306, and a parameter management unit 304.

When the link calibration is executed, on the other hand, the calibration execution control unit 303 outputs the patch transmission request signal to a PC communication unit 309. As a result, the external patch signal is input from the PC 101 such that the external patch image is displayed. At this time, the calibration execution control unit 303 outputs the measurement request signal to the colorimetry unit 307. Then, similarly to the single unit calibration, the calibration execution control unit 303 obtains the measurement results of the brightness/chromaticity sensor 210 (the brightness and the chromaticity of the displayed external patch image) from the colorimetry unit 307. Next, the calibration execution control unit 303 calculates the image quality adjustment parameter and the backlight emission parameter on the basis of the obtained brightness and chromaticity, and outputs the calculated parameters to the display control unit 305, the backlight control unit 306, and the parameter management unit 304.

The single unit calibration and the link calibration will be described in detail below.

The parameter management unit 304 writes the backlight emission parameter and the image quality adjustment parameter received from the calibration execution control unit 303 to the nonvolatile memory 203.

The display control unit 305 selects either the external input image signal output by the image input unit 308 or the single unit display image signal output by the single unit display image display control unit 312 in accordance with the switch request signal, and outputs the selected image signal to the image processing circuit 205. At this time, the display control unit 305 outputs an instruction to the image processing circuit 205 to use the image quality adjustment parameter corresponding to the selected image signal, and outputs an instruction to the backlight control unit 306 to use the backlight emission parameter corresponding to the selected image signal. As a result, the selected image signal is corrected by the image processing circuit 205, whereupon an image based on the corrected image signal is displayed.

Further, when the selected image is switched from the single unit display image signal to the external input image signal, the display control unit 305 outputs a display comparison request signal to the display comparison unit 311. The display comparison request signal is a signal indicating a request for a comparison to determine whether or not the brightness and chromaticity of the external patch image match target values.

Furthermore, the display control unit 305 generates a synthesized image signal by synthesizing the setting window signal received from the UI unit 301 and the patch signal received from the calibration execution control unit 303 with the selected image signal, and outputs the synthesized image signal to the image processing circuit 205. The synthesized image signal is a signal representing a synthesized image of the image based on the selected image signal and images such as the setting window and the patch image.

Further, the display control unit 305 outputs the image quality adjustment parameter received from the calibration execution control unit 303 during calibration to the image processing circuit 205.

The backlight control unit 306 outputs the parameter switching instruction (the instruction to use the backlight emission parameter corresponding to the image signal selected by the display control unit 305) received from the display control unit 305 to the backlight control circuit 207. Further, the backlight control unit 306 outputs the backlight emission parameter received from the calibration execution control unit 303 during calibration to the backlight control circuit 207.

The colorimetry unit 307 outputs the measurement request signal received from the calibration execution control unit 303 or the display comparison unit 311 to the sensor control circuit 209. Further, the colorimetry unit 307 obtains the measurement results (the brightness and the chromaticity) of the brightness/chromaticity sensor 210 from the sensor control circuit 209 in response to a request from the calibration execution control unit 303 or the display comparison unit 311, and outputs the obtained measurement results to the transmission source of the request.

An image input unit 308 outputs the external input image signal received by the image input circuit 204 from the PC 101 to the display control unit 305. Further, when the external input image signal from the PC 101 is detected, the image input unit 308 outputs an input detection signal to an input detection unit 310. When the external input image signal from the PC 101 is no longer detected, the image input unit 308 outputs an input cancellation signal to the input detection unit 310.

When the patch transmission request signal is transmitted from the calibration execution control unit 303 or the display comparison unit 311, the PC communication unit 309 outputs the patch transmission request signal to the PC 101 via the image input circuit 204. Further, the PC communication unit 309 receives the patch transmission completion signal from the PC 101 via the image input circuit 204, and outputs the received signal to the calibration execution control unit 303 or the display comparison unit 311 (the transmission source of the patch transmission request signal).

The input detection unit 310 determines whether or not the external input image signal has been input from the PC 101 on the basis of the input detection signal and the input cancellation signal received from the image input unit 308, and stores a determination result as input information. More specifically, the input detection unit 310 determines that the external input image signal has been input during a period extending from reception of the input detection signal to reception of the input cancellation signal, and determines that the external input image signal has not been input during all other periods. Further, the input detection unit 310 outputs the input information in response to a request from the calibration execution control unit 303.

During display of an external input image, the display comparison unit 311 determines whether or not an output setting of the external apparatus (the content of the image processing performed in the external apparatus or the like) or the second display setting (the external input image parameter) differs from a setting during display of a previous external input image.

More specifically, the display comparison unit 311 outputs the patch transmission request signal to the PC communication unit 309 upon reception of the display comparison request signal from the display control unit 305. As a result, the external patch signal is input from the PC 101, whereupon the external patch image is displayed. At this time, the display comparison unit 311 outputs the measurement request signal to the colorimetry unit 307. The display comparison unit 311 then obtains the measurement results of the brightness/chromaticity sensor 210 (the brightness and the chromaticity of the displayed external patch image) from the colorimetry unit 307. Next, the display comparison unit 311 compares the calibration setting information (the calibration target values) obtained from the calibration setting management unit 302 with the measurement results. A determination is then made from the comparison as to whether or not a difference exists between the output setting of the external apparatus or the external input image parameter and the setting during display of the previous external input image, and when it is determined that a difference exists, execution of the link calibration is determined to be required.

Having determined that execution of the link calibration is required, the display comparison unit 311 issues a request to the calibration execution control unit 303 to execute the link calibration. As described above, the calibration execution control unit 303 executes the link calibration upon reception of the link calibration execution request signal from the display comparison unit 311. In other words, according to this embodiment, the calibration execution control unit 303 executes the link calibration when the display comparison unit 311 determines that a difference exists between the output setting of the external apparatus or the external input image parameter and the setting during display of the previous external input image.

The determination processing performed by the display comparison unit 311 will be described in detail below.

The single unit display image display control unit 312 outputs an image transmission request signal to a network communication unit 313 in response to an instruction from the UI unit 301, and obtains an image file from the network communication unit 313. The single unit display image display control unit 312 then generates a single unit display image signal by decoding the obtained image file, implements synthesis processing with an image signal of an icon or the like and image processing instructed by the user on the single unit display image signal as required, and outputs the resulting single unit display image signal to the display control unit 305.

The network communication unit 313 transmits the image transmission request signal from the single unit display image display control unit 312 to the image server 103 via the network communication circuit 212, and obtains an image file from the image server 103. The network communication unit 313 then outputs the obtained image file to the single unit display image display control unit 312.

Note that the processing of the respective function blocks (the UI unit 301 to the network communication unit 313) shown in FIG. 3 is executed by the CPU 201.

Figure 4:
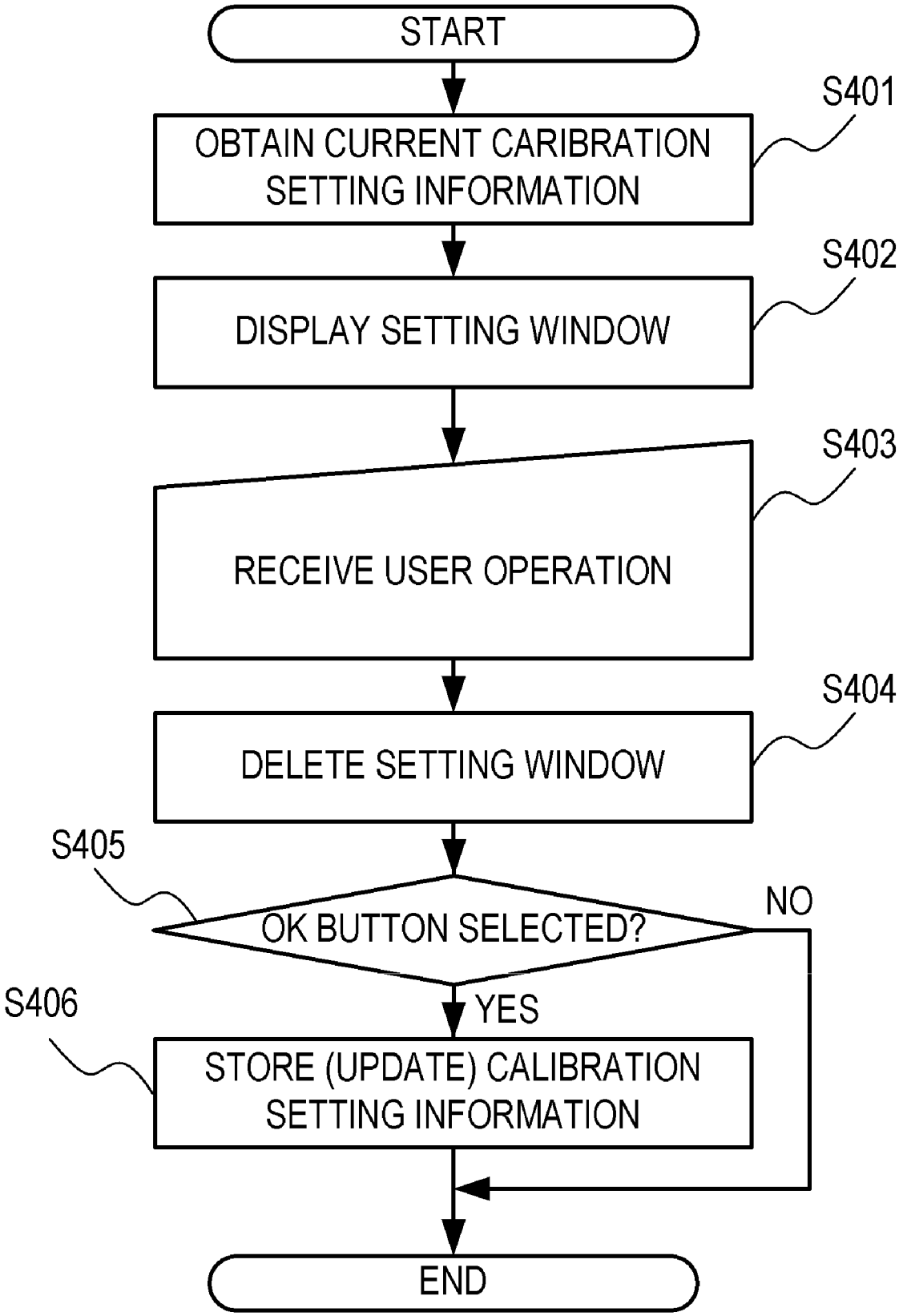
FIG. 4 shows an example of a flow of calibration setting information setting processing according to the first embodiment.

FIG. 4 is a flowchart showing an example of a flow of processing (calibration setting information setting processing) executed by the UI unit 301 when the user performs an operation to start setting the calibration setting information.

First, the UI unit 301 obtains the current calibration setting information from the calibration setting management unit 302 (S401).

Next, the UI unit 301 generates the setting window signal and outputs the generated signal to the display control unit 305 (S402). The display control unit 305 generates a synthesized image signal by synthesizing the setting window signal with the currently displayed image signal, and outputs the generated synthesized image signal. As a result, an image superimposing the setting window on the currently displayed image is displayed.

Next, the user performs an operation to modify the calibration setting information (the calibration target values) as required using the setting window, and then performs an operation to complete setting of the calibration setting information (S403). In this embodiment, as will be described in detail below, the setting window includes an OK button and a cancel button, and setting of the calibration setting information is completed when the user selects one of these two buttons.

When one of the two buttons is selected (when the operation to complete setting is performed), the UI unit 301 deletes (closes) the setting window (S404).

When the OK button is selected in S403 (S405: YES), the UI unit 301 outputs the set target values to the calibration setting management unit 302 as the calibration setting information (S406). As a result, the calibration setting information is stored (updated). The UI unit 301 then terminates the processing.

Further, when the cancel button is selected in S403 (S405: NO), the UI unit 301 terminates the processing.

Figure 5:
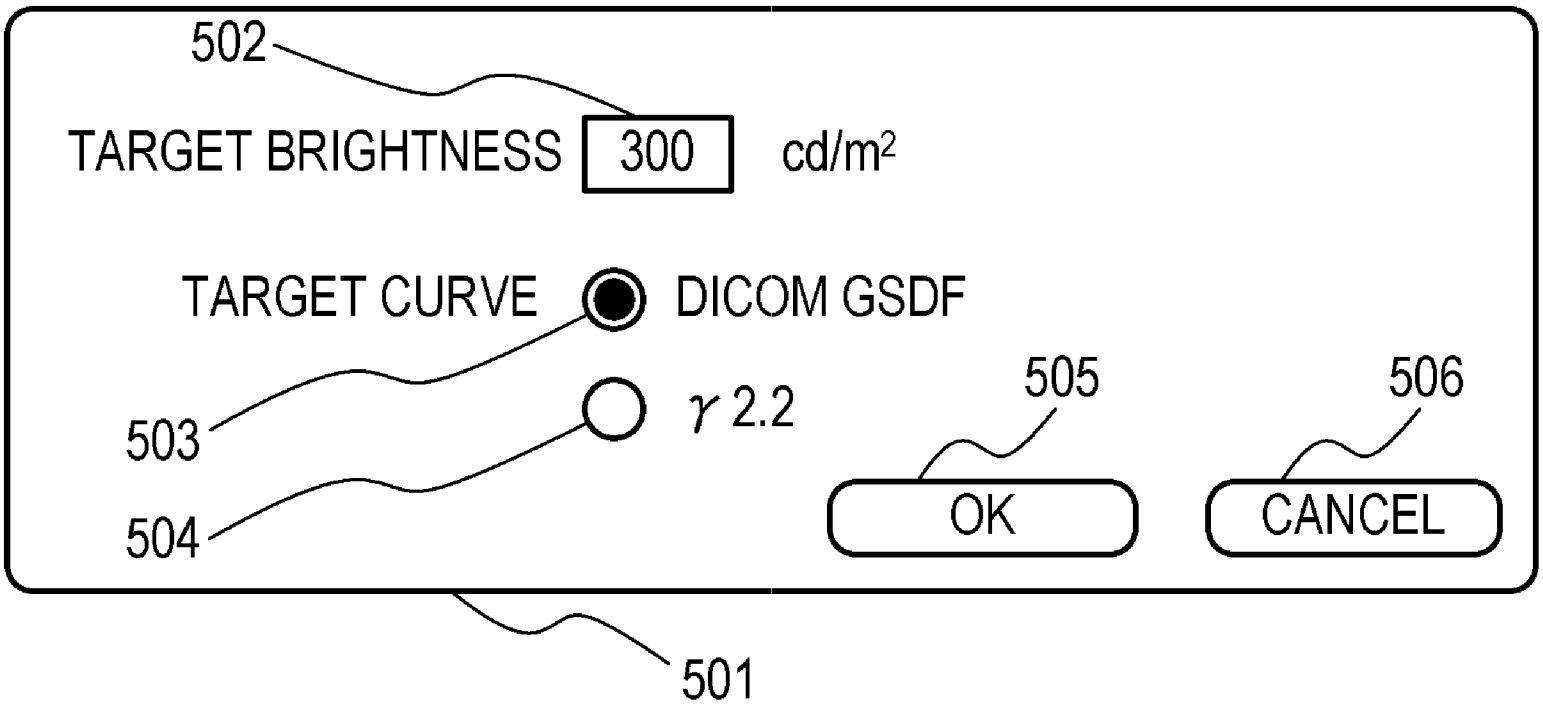
FIG. 5 shows an example of a setting window according to the first embodiment.

FIG. 5 is a view showing an example of the setting window.

A setting window 501 includes a text box 502, radio buttons 503, 504, an OK button 505, a cancel button 506, and so on.

The text box 502 is used to set the target maximum brightness value during calibration. In the example shown in FIG. 5, the target maximum brightness value during calibration is set at 300 cd/m$^2$.

The radio buttons 503, 504 are used to set the target gradation curve during calibration. When the radio button 503 is selected, the target gradation curve is set at DICOM GSDF, and when the radio button 504 is selected, the target gradation curve is set at $\gamma 2.2$. In the example shown in FIG. 5, the target gradation curve is set at DICOM GSDF. Note that the target gradation curve is not the focus of the present invention, and therefore detailed description thereof has been omitted.

The OK button 505 and the cancel button 506 are buttons for completing setting of the calibration setting information.

When the OK button 505 is selected, the calibration setting information indicated by the setting window is stored, whereby setting of the calibration setting information is completed. At this time, the UI unit 301 is notified that the OK button has been selected.

When the cancel button 506 is selected, setting of the calibration setting information is completed without storing the calibration setting information indicated by the setting window. In other words, when setting of the calibration setting information is completed by selecting the cancel button 506, any modification of the calibration setting information performed upon display of the setting window is invalidated. At this time, the UI unit 301 is notified that the cancel button has been selected (that the OK button has not been selected).

Figure 6:
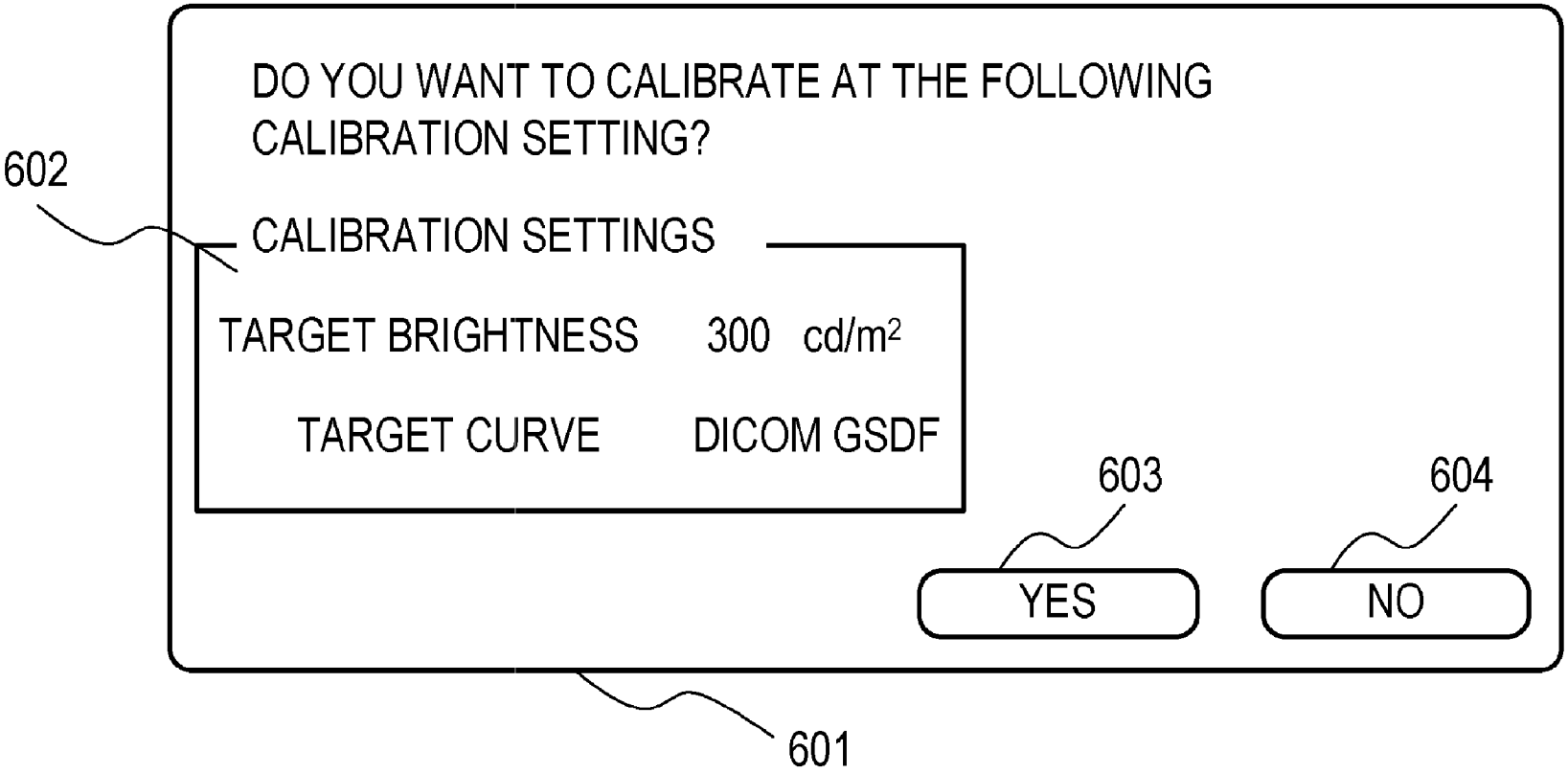
FIG. 6 shows an example of a normal calibration execution confirmation window according to the first embodiment.

FIG. 6 is a view showing an example of a window (a normal calibration execution confirmation window) displayed when execution of the normal calibration is begun. In this embodiment, the normal calibration is executed on the basis of an instruction from the user. The normal calibration execution confirmation window is displayed when the user performs an operation to start executing calibration, when the user performs the operation to complete setting of the calibration setting information, and so on, for example. More specifically, in response to a user operation, the UI unit 301 generates a normal calibration execution confirmation window signal and outputs the generated signal to the display control unit 305. As a result, the normal calibration execution confirmation window is displayed. In the normal calibration, both the single unit calibration and the link calibration are executed. Note, however, that when the external input image has not been input into the display apparatus 100 (when the external apparatus (the PC 101) is not connected to the display apparatus 100), the link calibration is not executed.

An execution confirmation window 601 includes an area 602 in which the calibration setting information (the target values) is displayed, a YES button 603, a NO button 604, and so on.

The user can check the current calibration setting information in the area 602.

The YES button 603 is pressed (selected) when the normal calibration based on the calibration setting information displayed in the area 602 is started. When the user selects the YES button 603, a normal calibration execution request signal is output from the UI unit 301 to the calibration execution control unit 303. In the example shown in FIG. 6, a request to execute the normal calibration in order to set the maximum target brightness value at 300 cd/m$^2$ and the target gradation curve at DICOM GSDF is issued from the UI unit 301 to the calibration execution control unit 303.

The NO button 604 is pressed (selected) by the user in order not to execute the normal calibration. When the user selects the NO button 604, the execution conformation window 601 is deleted (closed) without outputting the normal calibration execution request signal from the UI unit 301 to the calibration execution control unit 303.

Figure 7:
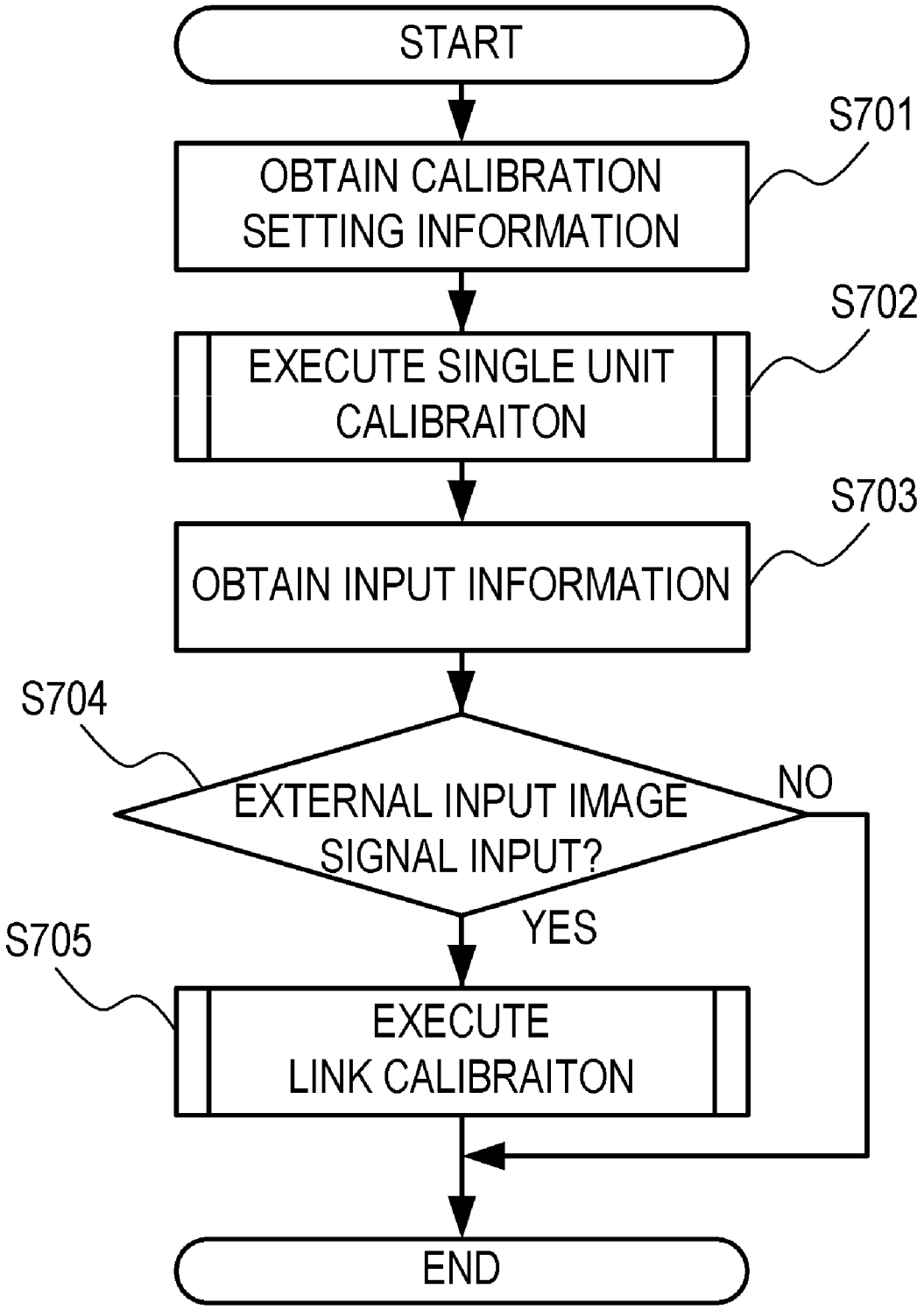
FIG. 7 shows an example of a flow of a normal calibration according to the first embodiment.

FIG. 7 is a flowchart showing an example of a flow of the normal calibration executed by the calibration execution control unit 303 upon reception of the normal calibration execution request signal.

First, the calibration execution control unit 303 obtains the calibration setting information from the calibration setting management unit 302 (S701).

Next, the calibration execution control unit 303 executes the single unit calibration (S702). A flowchart of the single unit calibration will be described below.

The calibration execution control unit 303 then obtains the input information from the input detection unit 310 (S703).

When the external input image signal has been input (S704: YES), the calibration execution control unit 303 goes on to execute the link calibration (S705). A flowchart of the link calibration will be described below. When the external input image signal has not been input (S704: NO), the calibration execution control unit 303 terminates the processing without performing the link calibration.

Figure 8:
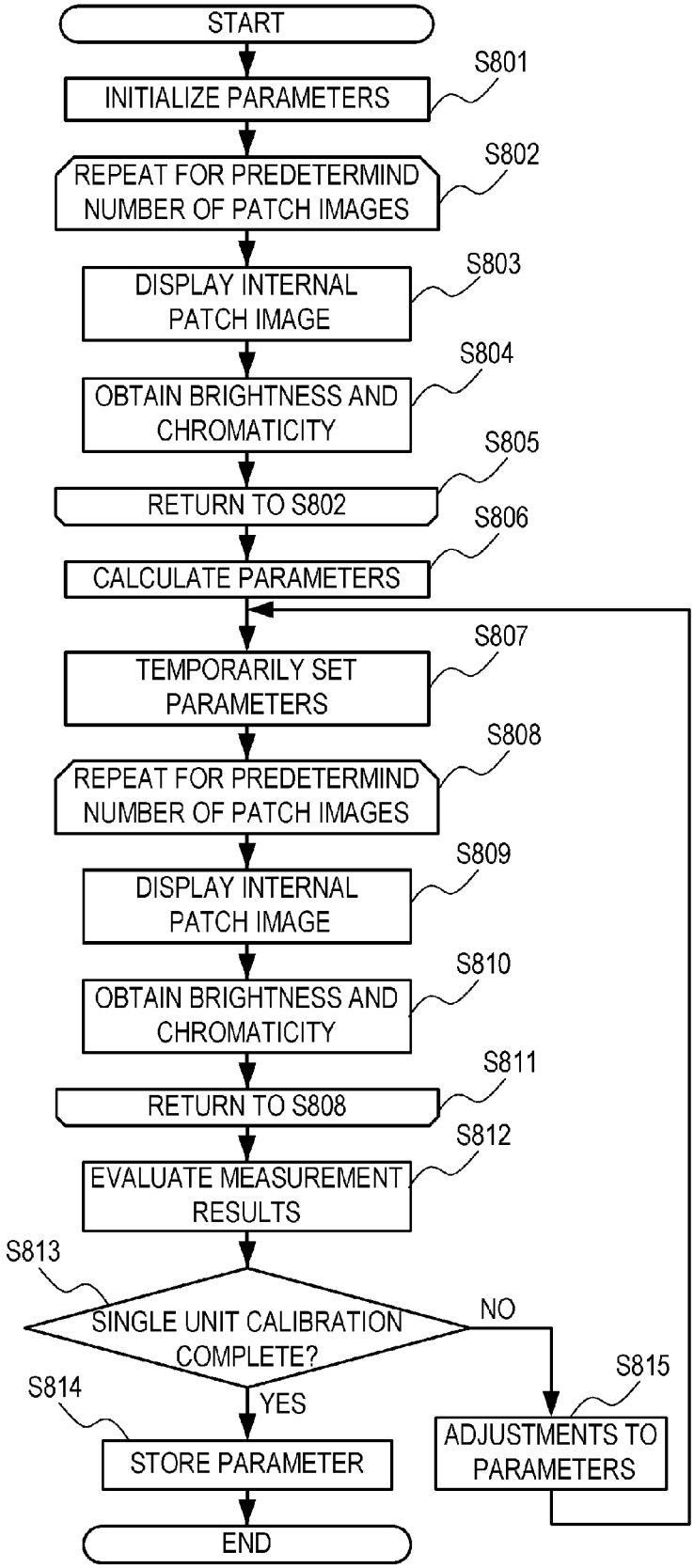
FIG. 8 shows an example of a flow of a single unit calibration according to the first embodiment.

FIG. 8 is a flowchart showing an example of a flow of the single unit calibration executed by the calibration execution control unit 303.

First, the calibration execution control unit 303 issues a request to the display control unit 305 to initialize the image quality adjustment parameter, and issues a request to the backlight control unit 306 to initialize the backlight emission parameter (S801). As a result, initial values of the parameters are used by the image processing circuit 205 and the backlight control circuit 207 to display an image.

Next, the calibration execution control unit 303 performs processing of S803 to S805 repeatedly for a predetermined number of patch images (S802).

First, the calibration execution control unit 303 outputs the internal patch signal to the display control unit 305 (S803). The display control unit 305 generates a synthesized image signal by synthesizing the received internal patch signal with the signal of the currently displayed image, and outputs the synthesized image signal. As a result, an image superimposing the internal patch image on the currently displayed image is displayed. Also at this time, the calibration execution control unit 303 outputs the measurement request signal to the colorimetry unit 307. As a result, the brightness and the chromaticity of the internal patch image are measured by the brightness/chromaticity sensor 210, whereupon the measurement results are obtained by the colorimetry unit 307.

Next, the calibration execution control unit 303 obtains the brightness and the chromaticity of the displayed internal patch image from the colorimetry unit 307 (S804).

The processing then returns to S802 (S805).

Once the processing of S803 to S805 has been performed repeatedly for the predetermined number of patch images, the processing advances to S806.

In S806, the calibration execution control unit 303 calculates the image quality adjustment parameter and the backlight emission parameter on the basis of the brightness and chromaticity values of the respective obtained patch images, the maximum target brightness value, and the target gradation curve.

Next, the calibration execution control unit 303 outputs the image quality adjustment parameter and the backlight emission parameter calculated in S806 to the display control unit 305 and the backlight control unit 306, respectively. As a result, the parameters calculated in S806 are temporarily set, and images are displayed using the temporarily set parameters (S807).

The calibration execution control unit 303 then performs processing of S809 to S811 repeatedly for the predetermined number of patch images (S808). The processing of S809 to S811 is similar to the processing of S803 to S805, and therefore description thereof has been omitted.

Once the processing of S809 to S811 has been performed repeatedly for the predetermined number of patch images, the processing advances to S812.

In S812, the calibration execution control unit 303 evaluates the measurement results (the brightness and the chromaticity) obtained in S810. More specifically, the calibration execution control unit 303 determines whether or not the brightness and the chromaticity of each patch image, obtained in S810, is within a predetermined error range of the target values (values based on the maximum target brightness value and the target gradation curve).

When the measurement results of the respective patch images are all within the predetermined error range of the target values, the calibration execution control unit 303 determines that the single unit calibration is complete (S813: YES), whereupon the processing advances to S814. In S814, the calibration execution control unit 303 outputs the image quality adjustment parameter and the backlight emission parameter calculated in S806 to the parameter management unit 304, where the respective parameters are recorded as the single unit display image parameters.

When a measurement result that is not within the predetermined error range of the target values exists, the calibration execution control unit 303 determines that the single unit calibration must be continued (S813: NO), whereupon the processing advances to S815. In S815, the calibration execution control unit 303 makes minute adjustments to the image quality adjustment parameter and the backlight emission parameter. The processing then returns to S807. When a measurement result that is not within the predetermined error range of the target values exists even after performing minute adjustments a predetermined number of times or more, the single unit calibration is determined to be complete (S813: YES), whereupon the processing advances to S814.

Figure 9:
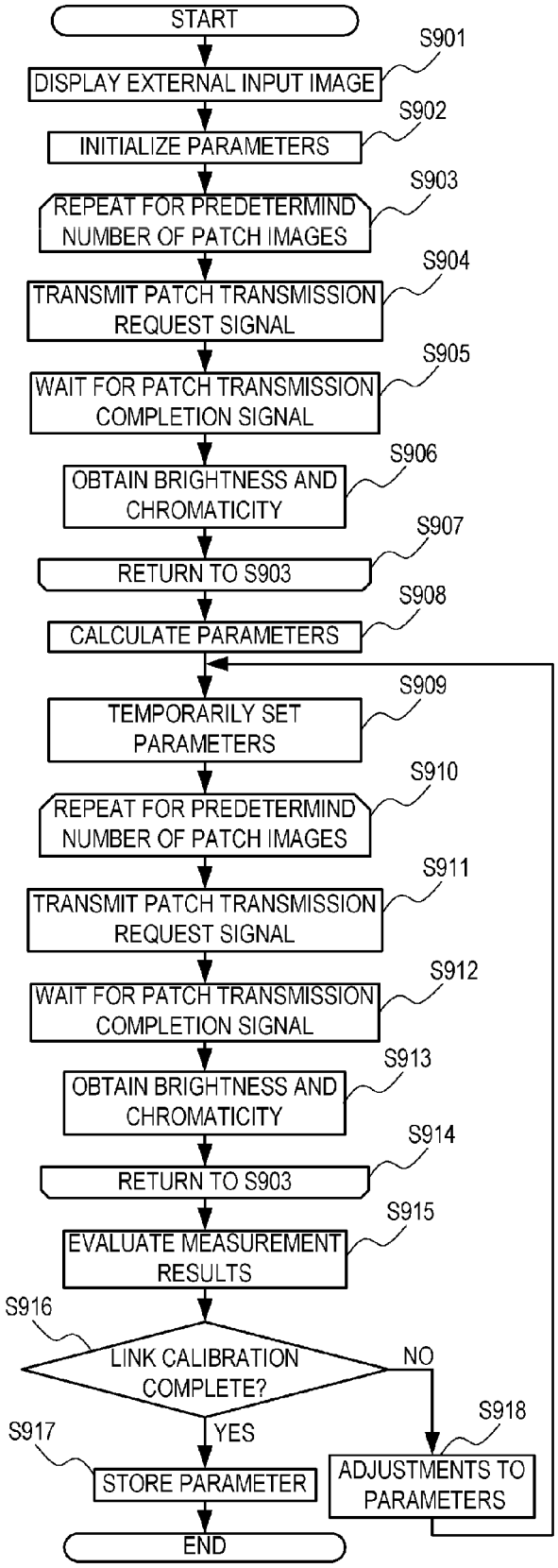
FIG. 9 shows an example of a flow of a link calibration according to the first embodiment.

FIG. 9 is a flowchart showing an example of a flow of the link calibration executed by the calibration execution control unit 303.

First, the calibration execution control unit 303 issues a request to the display control unit 305 to display an external input image based on an external input image signal to be output by the image input unit 308 (S901). Having received the request, the display control unit 305 selects and outputs the external input image signal to be output by the image input unit 308.

Next, similarly to the single unit calibration, the calibration execution control unit 303 issues a request to the display control unit 305 to initialize the image quality adjustment parameter, and issues a request to the backlight control unit 306 to initialize the backlight emission parameter (S902). As a result, the initial values of the parameters are used by the image processing circuit 205 and the backlight control circuit 207 to display an image.

Next, the calibration execution control unit 303 performs processing of S904 to S907 repeatedly for the predetermined number of patch images (S903).

First, the calibration execution control unit 303 transmits the patch transmission request signal to the PC communication unit 309 (S904). As a result, the patch transmission request signal is transmitted from the PC communication unit 309 to the PC 101.

Next, the calibration execution control unit 303 waits for the external patch signal to be received from the PC 101 by the image input unit 308 and for the patch transmission completion signal to be received from the PC 101 by the PC communication unit 309 (S905). When reception of the external patch signal is complete, the patch transmission completion signal is received by the PC communication unit 309, whereupon the patch transmission completion signal is transmitted from the PC communication unit 309 to the calibration execution control unit 303. At this time (as a result of the processing of S901), the external input image signal (including the external patch image) output by the image input unit 308 is selected by the display control unit 305. Therefore, when the external patch signal is received from the PC 101, an external patch image based on the external patch signal output by the PC 101 is displayed on the screen.

Having received the patch transmission completion signal, the calibration execution control unit 303 outputs the measurement request signal to the colorimetry unit 307. As a result, the brightness and the chromaticity of the external patch image are measured by the brightness/chromaticity sensor 210, whereupon the measurement results are obtained by the colorimetry unit 307. The calibration execution control unit 303 then obtains the brightness and the chromaticity of the displayed external patch image from the colorimetry unit 307 (S906).

The processing then returns to S903 (S907).

Once the processing of S904 to S907 has been performed repeatedly for the predetermined number of patch images, the processing advances to S908.

In S908, the calibration execution control unit 303 calculates the image quality adjustment parameter and the backlight emission parameter on the basis of the obtained brightness and chromaticity, the maximum target brightness value, and the target gradation curve.

Next, the calibration execution control unit 303 outputs the image quality adjustment parameter and the backlight emission parameter calculated in S908 to the display control unit 305 and the backlight control unit 306, respectively. As a result, the parameters calculated in S908 are temporarily set, and images are displayed using the temporarily set parameters (S909).

The calibration execution control unit 303 then performs processing of S911 to S914 repeatedly for the predetermined number of patch images (S910). The processing of S911 to S914 is similar to the processing of S904 to S907, and therefore description thereof has been omitted.

Once the processing of S911 to S914 has been performed repeatedly for the predetermined number of patch images, the processing advances to S915.

In S915, the calibration execution control unit 303 evaluates the measurement results (the brightness and the chromaticity) obtained in S913. More specifically, the calibration execution control unit 303 determines whether or not the brightness and the chromaticity of each patch image, obtained in S913, is within a predetermined error range of the target values (values based on the maximum target brightness value and the target gradation curve).

When the measurement results of the respective patch images are all within the predetermined error range of the target values, the calibration execution control unit 303 determines that the link calibration is complete (S916: YES), whereupon the processing advances to S917. In S917, the calibration execution control unit 303 outputs the image quality adjustment parameter and the backlight emission parameter calculated in S908 to the parameter management unit 304, where the respective parameters are recorded as the external input image parameters.

When a patch image having measurement results that are not within the predetermined error range of the target values exists, the calibration execution control unit 303 determines that the link calibration needs to be continued (S916: NO), whereupon the processing advances to S918. In S918, the calibration execution control unit 303 makes minute adjustments to the image quality adjustment parameter and the backlight emission parameter. The processing then returns to S909. When a patch image having measurement results that are not within the predetermined error range of the target values exists even after performing minute adjustments a predetermined number of times or more, the link calibration is determined to be complete (S918: YES), whereupon the processing advances to S917.

Note that in this embodiment, the calibration is determined to be complete when the measurement results of the respective patch images are all within the predetermined error range of the target values, but the present invention is not limited to this configuration. For example, the calibration may be determined to be complete when the number of measurement results within the predetermined error range of the target values equals or exceeds a predetermined number (at least a predetermined proportion of the measurement results).

Figure 10:
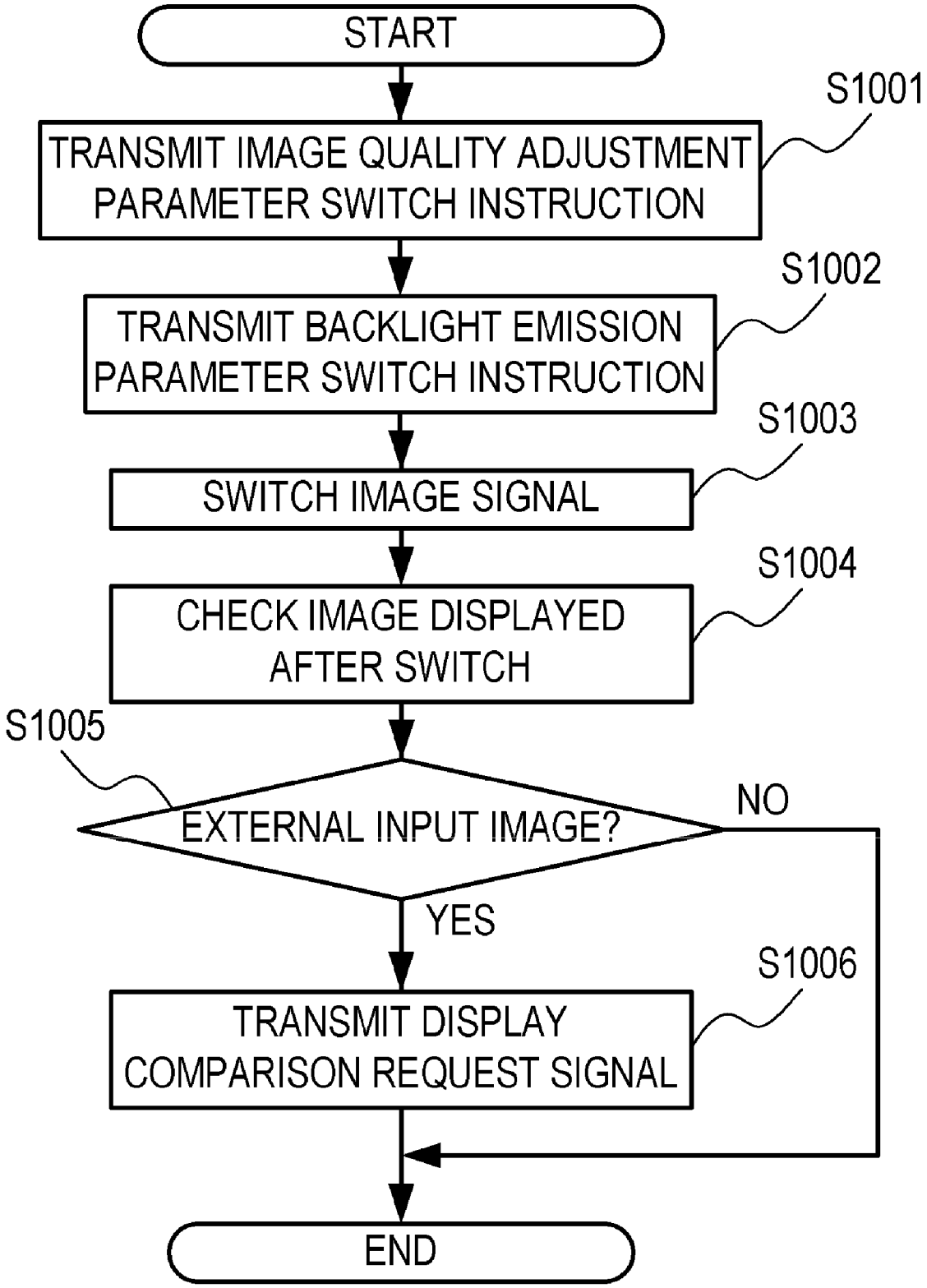
FIG. 10 shows an example of a flow of selection signal switching processing according to the first embodiment.

FIG. 10 is a flowchart showing an example of a flow of processing (selected signal switching processing) executed by the display control unit 305 upon reception of the switch request signal from the UI unit 301 in response to a user operation.

First, the display control unit 305 transmits an image quality adjustment parameter switch instruction to the image processing circuit 205 to switch the used image quality adjustment parameter to an image quality adjustment parameter for a post-display switch image (S1001). Upon reception of the image quality adjustment parameter switch instruction, the image processing circuit 205 reads the image quality adjustment parameter for a post-display switch image from the nonvolatile memory 203. As a result, image processing using the image quality adjustment parameter for a post-display switch image is executed in the image processing circuit 205.

Next, the display control unit 305 outputs a backlight emission parameter switch instruction to the backlight control unit 306 to switch the used backlight emission parameter to a backlight emission parameter for a post-display switch image (S1002). The backlight control unit 306 outputs the received backlight emission parameter switch instruction to the backlight control unit 207. Upon reception of the backlight emission parameter switch instruction, the backlight control circuit 207 reads the backlight emission parameter for a post-display switch image from the nonvolatile memory 203. As a result, backlight control signal generation using the backlight emission parameter for a post-display switch image is executed in the backlight control circuit 207.

The display control unit 305 then switches the output image signal on the basis of the switch request signal (S1003).

Next, the display control unit 305 determines on the basis of the switch request signal whether the image displayed after the switch is a single unit display image or an external input image (S1004).

When the image displayed after the switch is an external input image (S1005: YES), the display control unit 305 transmits the display comparison request signal to the display comparison unit 311 (S1006).

When the image displayed after the switch is a single unit display image (S1005: NO), the display control unit 305 terminates the processing as is.

Figure 11:
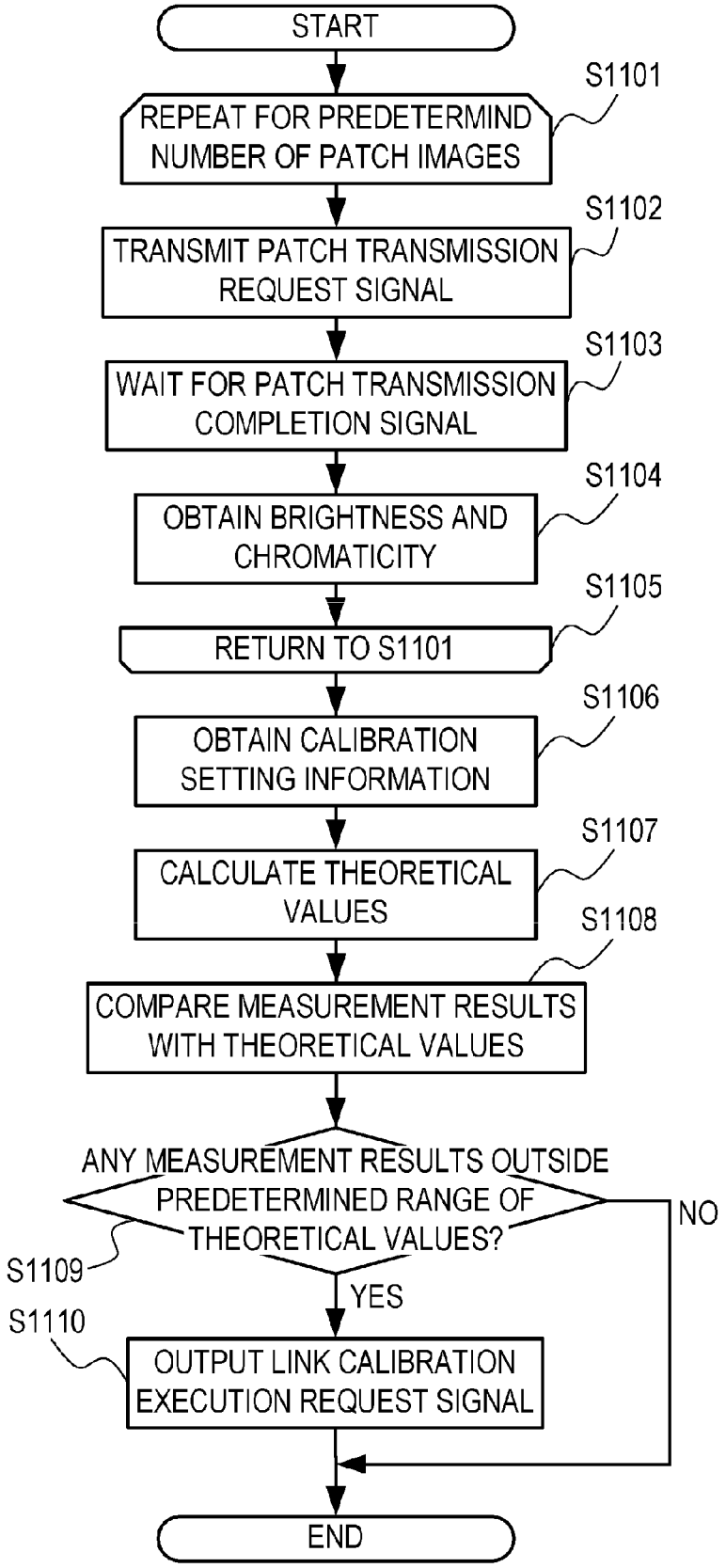
FIG. 11 shows an example of a flow of comparison processing executed by a display comparison unit according to the first embodiment.

FIG. 11 is a flowchart showing an example of a flow of processing (comparison processing) executed by the display comparison unit 311 upon reception of the display comparison request signal from the display control unit 305.

First, the display comparison unit 311 performs processing of S1102 to S1105 repeatedly for the predetermined number of patch images (S1101).

In S1102, the display comparison unit 311 transmits the patch transmission request signal to the PC communication unit 309. As a result, the patch transmission request signal is transmitted from the PC communication unit 309 to the PC 101.

Next, the display comparison unit 311 waits for the external patch signal to be received from the PC 101 by the image input unit 308 and for the patch transmission completion signal to be received from the PC 101 by the PC communication unit 309 (S1103). When reception of the external patch signal is complete, the patch transmission completion signal is received by the PC communication unit 309, whereupon the patch transmission completion signal is transmitted from the PC communication unit 309 to the display comparison unit 311. At this time, the external input image signal (including the external patch image) output by the image input unit 308 is selected by the display control unit 305. Therefore, when the external patch signal is received from the PC 101, an external patch image based on the external patch signal output by the PC 101 is displayed on the screen at the external input image parameter.

Having received the patch transmission completion signal, the display comparison unit 311 outputs the measurement request signal to the colorimetry unit 307. As a result, the brightness and the chromaticity of the external patch image are measured by the brightness/chromaticity sensor 210, whereupon the measurement results are obtained by the colorimetry unit 307. The display comparison unit 311 then obtains the brightness and the chromaticity of the displayed external patch image from the colorimetry unit 307 (S1104).

The processing then returns to S1101 (S1105).

Once the processing of S1102 to S1105 has been performed repeatedly for the predetermined number of patch images, the processing advances to S1106.

In S1106, the display comparison unit 311 obtains the calibration setting information from the calibration setting management unit 302.

Next, the display comparison unit 311 calculates theoretical values (target values) of the brightness and chromaticity using the calibration setting information obtained in S1106 (S1107).

The display comparison unit 311 then compares the measurement results (the brightness and the chromaticity) obtained in S1104 with the theoretical values calculated in S1107 (S1108), and determines from the comparison whether or not a difference exists between the output setting of the external apparatus or the external input image parameter and the setting during display of the previous external input image.

When a measurement result that is not within a predetermined error range of the theoretical values exists (S1109: YES), the possibility that a difference exists between the output setting of the external apparatus or the external input image parameter and the setting during display of the previous external input image is high. Therefore, when such a case arises in this embodiment, the display comparison unit 311 determines that a difference exists between the output setting of the external apparatus or the external input image parameter and the setting during display of the previous external input image. Accordingly, the display comparison unit 311 determines that the link calibration is required, and outputs the link calibration execution request signal to the calibration execution control unit 303 (S1110).

When all of the measurement results are within the predetermined error range of the theoretical values (S1109: NO), the display comparison unit 311 determines that the output setting of the external apparatus or the external input image parameter and the setting during display of the previous external input image are identical, and terminates the processing as is.

Hence, when an external input image is displayed in this embodiment, the external patch image is displayed at the second display setting (the external input image parameter). When an absolute value of a difference between the measurement values of the external patch image measured by the brightness/chromaticity sensor 210 and the target values is greater than a predetermined threshold, it is determined that a difference exists between the output setting of the external apparatus or the external input image parameter and the setting during display of the previous external input image.

Note that in this embodiment, a difference is determined to exist between the output setting of the external apparatus or the external input image parameter and the setting during display of the previous external input image when a measurement result that is not within the predetermined error range of the theoretical values exists, but the present invention is not limited to this configuration. For example, a difference may be determined to exist between the output setting of the external apparatus or the external input image parameter and the setting during display of the previous external input image when the number of measurement results not within the predetermined error range of the target values equals or exceeds a predetermined number (at least a predetermined proportion of the measurement results).

Figure 12:
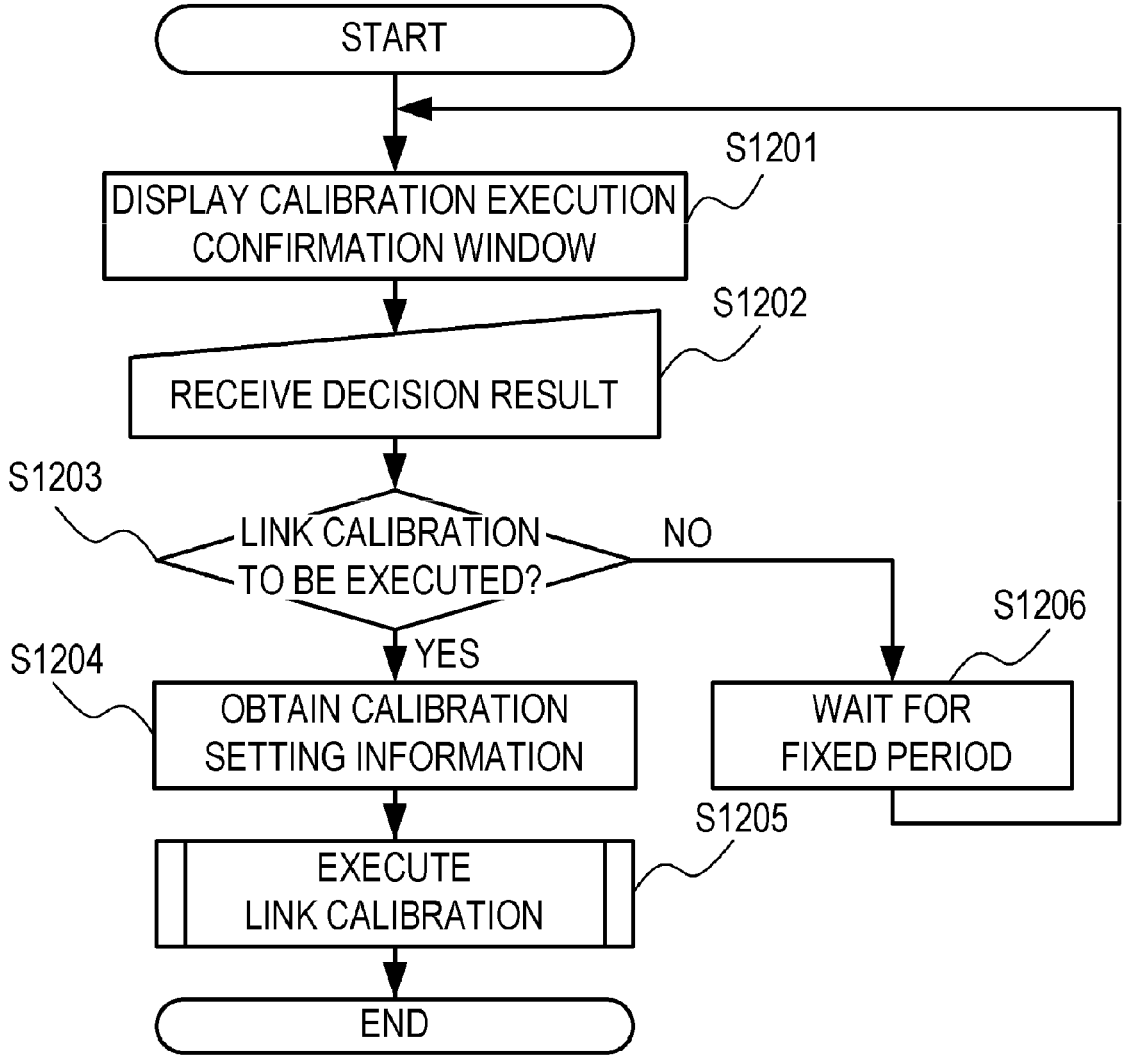
FIG. 12 shows an example of a flow of a non-normal link calibration according to the first embodiment.

FIG. 12 is a flowchart showing an example of a flow of processing (a non-normal link calibration) executed by the calibration execution control unit 303 upon reception of the link calibration execution request signal from the display comparison unit 311.

First, the calibration execution control unit 303 issues a request to the UI unit 301 to display the link calibration execution confirmation window (S1201). In response to the request, the UI unit 301 generates the link calibration execution confirmation window signal and outputs the generated signal to the display control unit 305. As a result, the link calibration execution confirmation window is displayed. The user uses the link calibration execution confirmation window to decide whether or not to execute the link calibration.

Next, the calibration execution control unit 303 receives a result of the decision made by the user as to whether or not to execute the link calibration from the UI unit 301 (S1202).

When the user decides to execute the link calibration (S1203: YES), the calibration execution control unit 303 obtains the calibration setting information from the calibration setting management unit 302 (S1204). The calibration execution control unit 303 then executes the link calibration shown in FIG. 9 using the maximum target brightness value and the target gradation curve included in the calibration setting information (S1205).

When the user decides not to execute the link calibration (S1203: NO), the calibration execution control unit 303 waits for a fixed time (S1206), whereupon the processing returns to S1201.

Figure 13:
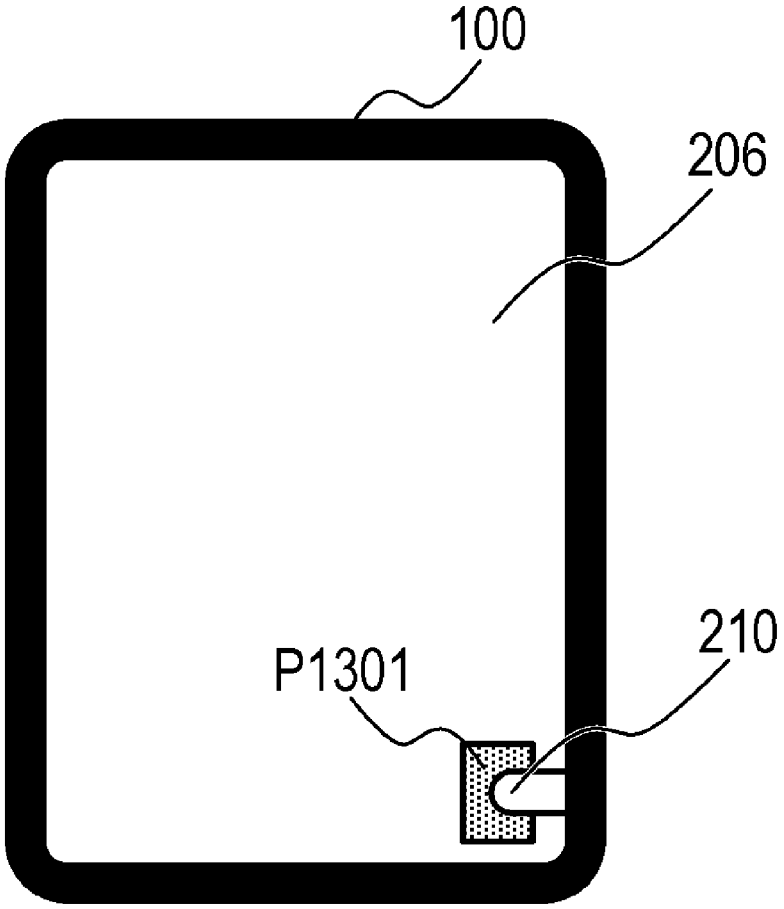
FIG. 13 shows an example of an image displayed during execution of the calibration according to the first embodiment.

FIG. 13 is an image diagram showing an image displayed on the display apparatus 100 during execution of the single unit calibration and the link calibration.

As shown in FIG. 13, during calibration, a patch image P1301 is displayed in the vicinity of the brightness/chromaticity sensor 210 so that the brightness and chromaticity of the patch image can be measured by the brightness/chromaticity sensor 210.

Figure 14:
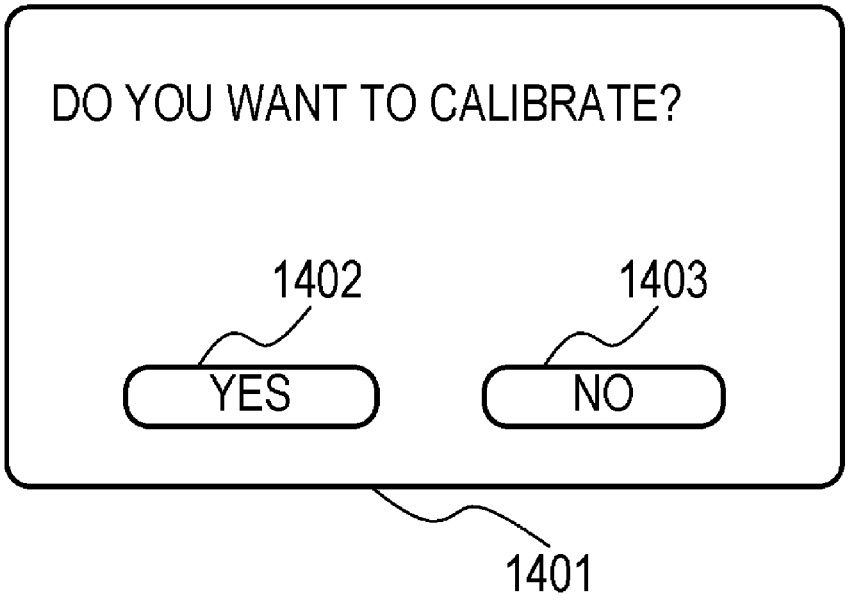
FIG. 14 shows an example of a link calibration execution confirmation window according to the first embodiment.

FIG. 14 is a view showing an example of the link calibration execution confirmation window.

A link calibration execution confirmation window 1401 includes buttons 1402, 1403 for selecting whether or not to execute the link calibration, and so on.

Having decided to execute the link calibration, the user presses (selects) the button 1402.

Having decided not to execute the link calibration, the user presses (selects) the button 1403.

The result of the decision (a signal representing the selected button) is then input into the UI unit 301.

According to this embodiment, as described above, a determination is made when an external input image is displayed as to whether or not a difference exists between the output setting of the external apparatus or the second display setting (the external input image parameter) and the setting during display of the previous external input image. When a difference is determined to exist between the output setting of the external apparatus or the second display setting and the setting during display of the previous external input image, the link calibration is executed. For example, the link calibration is executed when the output setting of the external apparatus connected to the display apparatus differs from the setting during display of the previous external input image, when the external apparatus connected to the display apparatus differs from the apparatus connected thereto during display of the previous external input image, and so on. In so doing, a difference between the display characteristic of an image based on an image signal input from the external apparatus and the display characteristic of an image displayed by the monitor alone can be suppressed.

Note that in this embodiment, the calibration target values are obtained from the maximum target brightness value and the target gradation curve, but the target values may be obtained using other values such as a color temperature. Further, the target values used during execution of the link calibration are not limited to values obtained from the calibration setting information, and the results of the single unit calibration (the brightness and chromaticity of the internal patch image displayed at the single unit display image parameter) may be used instead.

Note that the external patch signal may be an image signal representing a patch image alone or an image signal representing an image including an image area other than the patch image (an image on which the patch image is included in a partial area).

In this embodiment, the displayed image is switched to an external input image when the link calibration is executed. However, the present invention is not limited to this configuration, and similarly to the single unit calibration (the processing of S702), for example, an image signal representing only the external patch image (or the external patch image and the vicinity thereof) may be input into the display control unit 305. The display control unit 305 may then generate a synthesized image signal by synthesizing the input image signal with the signal of the currently displayed image, and output the synthesized image signal. In other words, an image superimposing the external patch image on the currently displayed image (a single unit display image, for example) may be displayed instead of switching the displayed image.

In this embodiment, a determination as to whether or not to execute the link calibration is made when the user performs an operation to switch the displayed image to an external input image. However, the present invention is not limited to this configuration, and the display control unit 305 may be instructed to switch the displayed image to an external input image when the input detection unit 310 determines that the external input image signal has been input, whereby the displayed image is switched to an external input image automatically. Alternatively, when the input detection unit 310 determines that the external input image signal has been input, the external patch image (or the external patch image and the vicinity thereof) may be displayed alone by being superimposed on the currently displayed image, and a determination may be made as to whether or not to execute the link calibration. Note that when the external patch image is displayed alone by being superimposed on the currently displayed image, the image is displayed using the external input image parameter.

In this embodiment, the normal calibration is executed in response to a user operation. However, the present invention is not limited to this configuration, and the normal calibration may be executed automatically. For example, the normal calibration may be executed periodically in accordance with a predetermined schedule. The normal calibration may also be executed in response to an instruction from the external apparatus (the PC 101, a server connected via a network, or the like).

Further, in a case where a calibration execution schedule is determined in advance, the normal calibration execution confirmation window may be displayed periodically in accordance with the schedule. Moreover, in a case where the external apparatus issues an instruction to execute calibration, the normal calibration execution confirmation window may be displayed in response to the instruction.

In this embodiment, the user confirms whether or not to execute the link calibration when a difference is determined to exist between the output setting of the external apparatus or the second display setting and the setting during display of the previous external input image. However, the present invention is not limited to this configuration, and the link calibration may be executed automatically without the need for user confirmation when a difference is determined to exist between the output setting of the external apparatus or the second display setting and the setting during display of the previous external input image.

In this embodiment, signals (the patch transmission request signal and the patch transmission completion signal) other than image signals may be transmitted between the display apparatus 100 and the PC 101 using a different communication cable to the image cable. For example, signals other than image signals may be transmitted using a USB (Universal Serial Bus) cable.

In this embodiment, the display apparatus 100, the PC 101, and the image server 103 are connected to each other by the network cable 104, but the display apparatus 100, the PC 101, and the image server 103 may be connected to be capable of mutual communication wirelessly.

In this embodiment, an example in which the display apparatus is a liquid crystal display apparatus was described, but the display apparatus is not limited thereto, and may be an organic EL display apparatus, a plasma display apparatus, and so on.

In this embodiment, a single external input image parameter is determined, but the present invention is not limited to this configuration, and instead, the display apparatus 100 may recognize the external apparatus (PC) connected thereto and determine the external input image parameter for each external apparatus.

Second Embodiment

In this embodiment, an example in which the results of the single unit calibration (the brightness and the chromaticity of the internal patch image displayed at the single unit display image parameter) are used as the target values of the link calibration will be described. Note that description of parts that are identical to the first embodiment has been omitted.

A function block diagram of the display apparatus according to a second embodiment of the present invention is similar to the first embodiment (FIG. 3).

The calibration execution control unit 303 according to this embodiment uses the measurement results of the internal patch image as target values when performing the link calibration in response to the link calibration execution request signal from the display comparison unit 311. All other functions of the calibration execution control unit 303 are similar to the first embodiment.

When the displayed image is switched from a single unit display image to an external input image, the display control unit 305 according to this embodiment outputs a pre-switch data acquisition request signal to the display comparison unit 311 before the switch and outputs the display comparison request signal to the display comparison unit 311 after the switch. All other functions of the display control unit 305 are similar to the first embodiment. The pre-switch data acquisition request signal is a signal for requesting acquisition of the brightness and the chromaticity of the internal patch image displayed at the first display setting (the single unit display image parameter).

The display comparison unit 311 according to this embodiment outputs the pre-stored internal patch signal to the display control unit 305 upon reception of the pre-switch data acquisition request signal from the display control unit 305. As a result, the internal patch image is displayed at the single unit display image parameter. At this time, the display comparison unit 311 outputs the measurement request signal to the colorimetry unit 307. The display comparison unit 311 then obtains the measurement results of the brightness/chromaticity sensor 210 (the brightness and the chromaticity of the internal patch image) from the colorimetry unit 307 and stores the measurement results as pre-switch data. After storing the pre-switch data, the display comparison unit 311 outputs a pre-switch data acquisition completion signal to the display control unit 305.

Further, the display comparison unit 311 outputs the patch transmission request signal to the PC communication unit 309 upon reception of the display comparison request signal from the display control unit 305. As a result, the external patch signal is input from the PC 101 such that the external patch image is displayed. At this time, the display comparison unit 311 outputs the measurement request signal to the colorimetry unit 307. The display comparison unit 311 then obtains the measurement results of the brightness/chromaticity sensor 210 (the brightness and the chromaticity of the external patch image) from the colorimetry unit 307. Next, the display comparison unit 311 compares the pre-switch data with the measurement results. A determination is then made from the comparison as to whether or not a difference exists between the output setting of the external apparatus or the external input image parameter and the setting during display of the previous external input image, and when it is determined that a difference exists, execution of the link calibration is determined to be required. Having determined that execution of the link calibration is required, the display comparison unit 311 issues a request to the calibration execution control unit 303 to execute the link calibration.

Determination processing executed by the display comparison unit 311 will be described in detail below.

Figure 15:
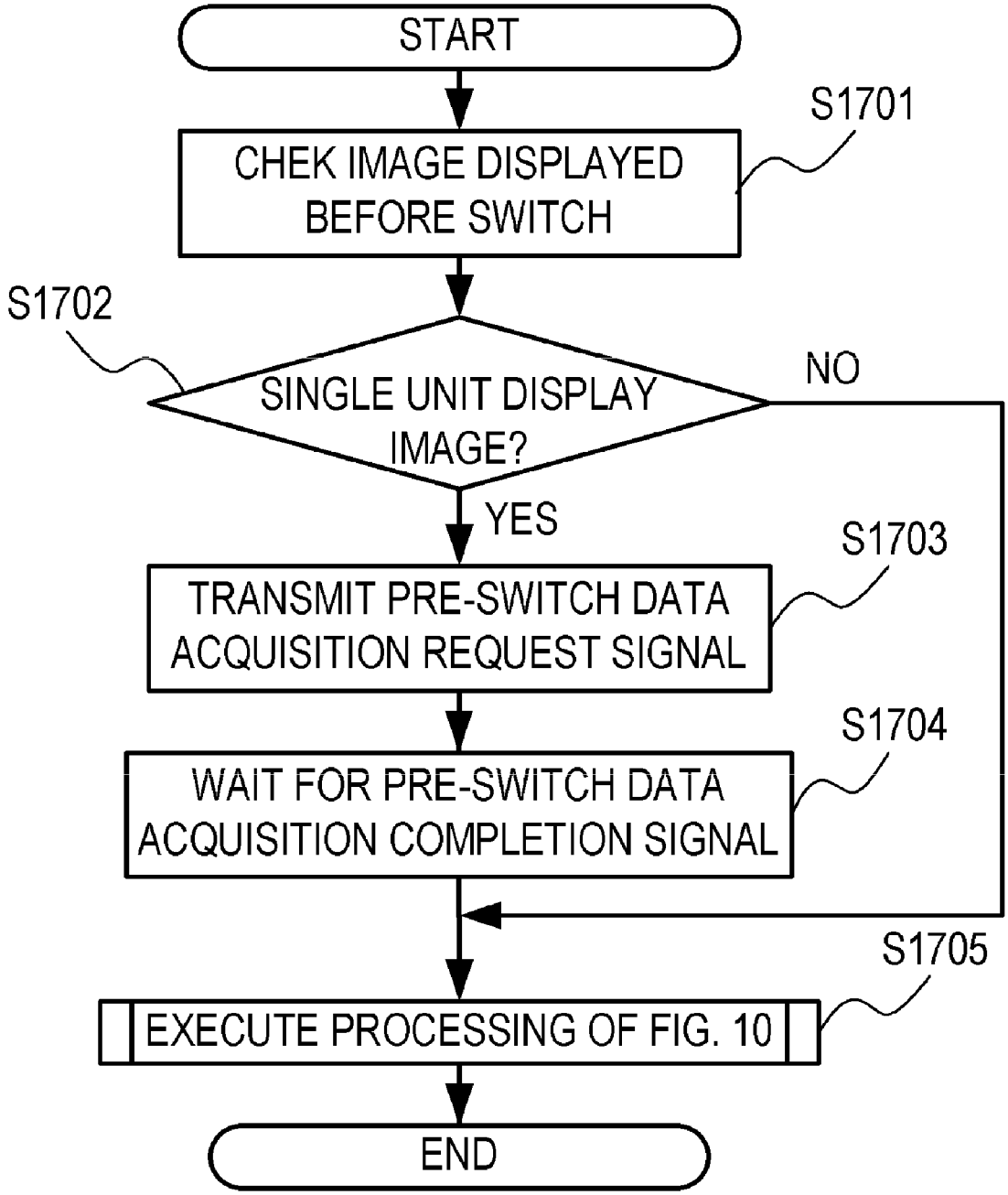
FIG. 15 shows an example of a flow of selection signal switching processing according to a second embodiment.

FIG. 15 is a flowchart showing an example of a flow of processing (selected signal switching processing) executed by the display control unit 305 upon reception of the switch request signal from the UI unit 301 in response to a user operation.

First, the display control unit 305 determines whether or not the image displayed prior to the switch (i.e. currently) is a single unit display image (S1701).

When the displayed image is a single unit display image (S1702: YES), the display control unit 305 transmits the pre-switch data acquisition request signal to the display comparison unit 311 (S1703) and waits to receive the pre-switch data acquisition completion signal (S1704). Having received the pre-switch data acquisition completion signal, the display control unit 305 executes the processing shown in FIG. 10 (S1705).

When the displayed image is an external input image, the display control unit 305 performs the processing of S1705 without performing the processing of S1703 to S1704.

Figure 16:
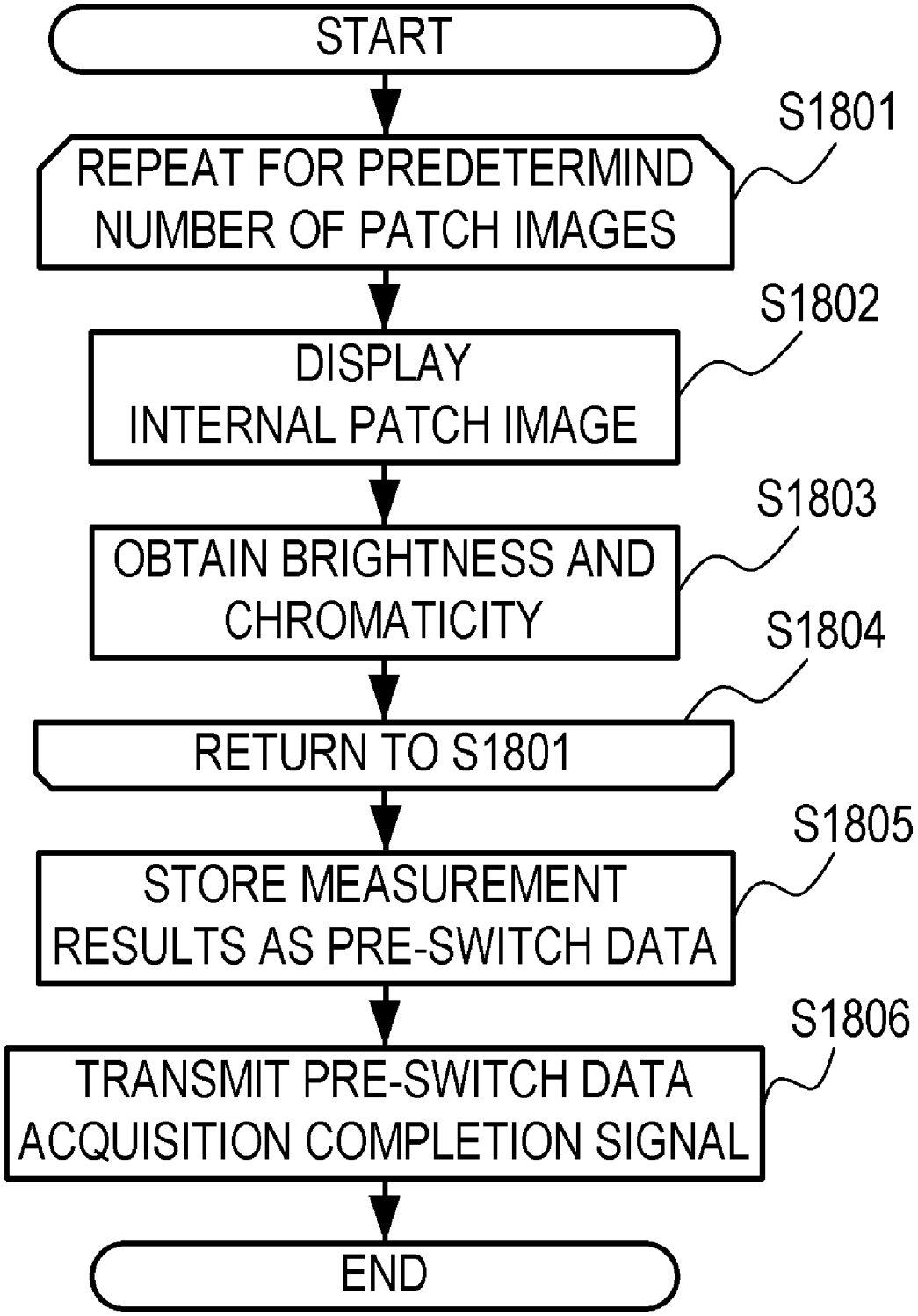
FIG. 16 shows an example of a flow of pre-switch data storage processing according to the second embodiment.

FIG. 16 is a flowchart showing an example of a flow of processing (pre-switch data storage processing) performed by the display comparison unit 311 upon reception of the pre-switch data acquisition request signal from the display control unit 305.

First, the display comparison unit 311 performs processing of S1802 to S1805 repeatedly for the predetermined number of patch images (S1801).

In S1802, the display comparison unit 311 outputs the internal patch signal to the display control unit 305. The display control unit 305 generates a synthesized image signal by synthesizing the received internal patch signal with the signal of the currently displayed image, and outputs the synthesized image signal. As a result, an image superimposing the internal patch image on the currently displayed image is displayed. At this time, the single unit display image (signal) is selected in the display control unit 305. Therefore, the internal patch image is displayed using the single unit display image parameter. Also at this time, the display comparison unit 311 outputs the measurement request signal to the colorimetry unit 307. As a result, the brightness and the chromaticity of the internal patch image are measured by the brightness/chromaticity sensor 210, whereupon the measurement results are obtained by the colorimetry unit 307.

Next, the display comparison unit 311 obtains the brightness and the chromaticity of the displayed internal patch image from the colorimetry unit 307 (S1803).

The processing then returns to S1801 (S1804).

Once the processing of S1802 to S1805 has been performed repeatedly for the predetermined number of patch images, the display comparison unit 311 stores the obtained measurement results (the brightness and the chromaticity) as the pre-switch data (S1805).

The display comparison unit 311 then transmits the pre-switch data acquisition completion signal to the display control unit 305 (S1806).

Figure 17:
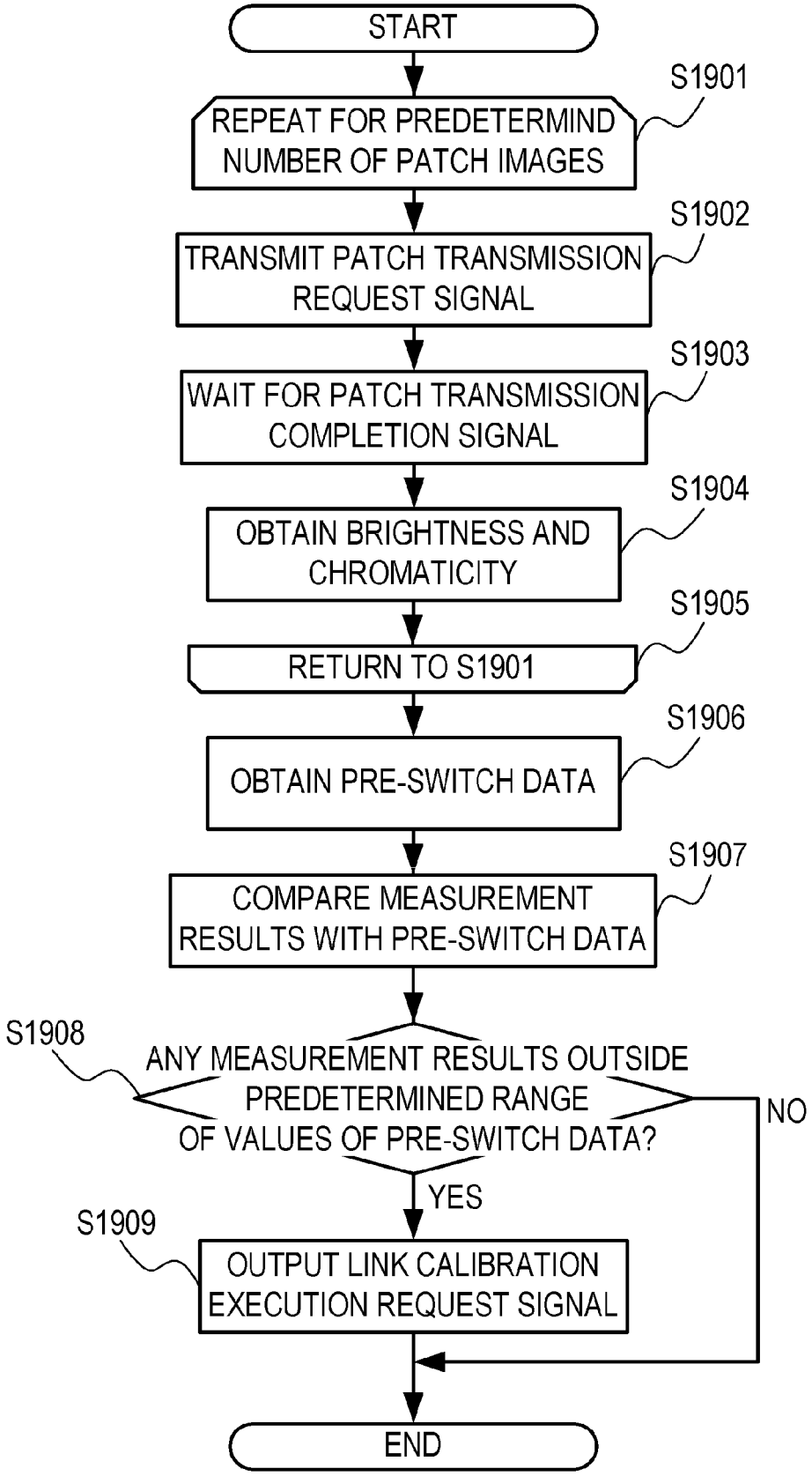
FIG. 17 shows an example of a flow of comparison processing executed by a display comparison unit according to the second embodiment.

FIG. 17 is a flowchart showing an example of a flow of processing (comparison processing) executed by the display comparison unit 311 upon reception of the display comparison request signal from the display control unit 305.

First, the display comparison unit 311 performs processing of S1902 to S1905 repeatedly for the predetermined number of patch images (S1901).

In S1902, the display comparison unit 311 transmits the patch transmission request signal to the PC communication unit 309. As a result, the patch transmission request signal is transmitted from the PC communication unit 309 to the PC 101.

Next, the display comparison unit 311 waits for the external patch signal to be received from the PC 101 by the image input unit 308 and the patch transmission completion signal to be received from the PC 101 by the PC communication unit 309 (S1903). When reception of the external patch signal is complete, the patch transmission completion signal is received by the PC communication unit 309, whereupon the patch transmission completion signal is transmitted from the PC communication unit 309 to the display comparison unit 311. At this time, the external input image signal (including the external patch image) output by the image input unit 308 is selected in the display control unit 305. Therefore, when the external patch signal is received from the PC 101, an external patch image based on the external patch signal output by the PC 101 is displayed on the screen using the external input image parameter.

Having received the patch transmission completion signal, the display comparison unit 311 outputs the measurement request signal to the colorimetry unit 307. As a result, the brightness and the chromaticity of the external patch image are measured by the brightness/chromaticity sensor 210, whereupon the measurement results are obtained by the colorimetry unit 307. The display comparison unit 311 then obtains the brightness and the chromaticity of the displayed external patch image from the colorimetry unit 307 (S1904).

The processing then returns to S1901 (S1905).

Once the processing of S1902 to S1905 has been performed repeatedly for the predetermined number of patch images, the processing advances to S1906.

In S1906, the display comparison unit 311 obtains the pre-switch data stored during the processing of FIG. 16.

Next, the display comparison unit 311 compares the measurement results (the brightness and the chromaticity) obtained in S1904 with values of the pre-switch data obtained in S1906 (S1907), and determines from the comparison whether or not a difference exists between the output setting of the external apparatus or the external input image parameter and the setting during display of the previous external input image. In other words, according to this embodiment, the values of the pre-switch data are set as the target values. Note that when no pre-switch data exist, the measurement results are compared with target values calculated as theoretical values, similarly to the first embodiment.

When a measurement result that is not within a predetermined error range of the values of the pre-switch data exists (S1908: YES), the display comparison unit 311 determines that a difference exists between the output setting of the external apparatus or the external input image parameter and the setting during display of the previous external input image. Accordingly, the display comparison unit 311 determines that the link calibration is required, and outputs the link calibration execution request signal to the calibration execution control unit 303 (S1909).

When all of the measurement results are within the predetermined error range of the values of the pre-switch data (S1908: NO), the display comparison unit 311 determines that the output setting of the external apparatus or the external input image parameter and the setting during display of the previous external input image are identical, and terminates the processing as is.

Hence, when an external input image is displayed in this embodiment, the external patch image is displayed at the external input image parameter. When an absolute value of a difference between measurement values of the external patch image and the measurement values of the internal patch image displayed at the single unit display image parameter is greater than a predetermined threshold, it is determined that a difference exists between the output setting of the external apparatus or the second display setting and the setting during display of the previous external input image. In other words, according to this embodiment, the measurement values of the internal patch image measured by the brightness/chromaticity sensor 210 during display of the internal patch image stored in advance in the display apparatus at the first display setting (the single unit display image parameter) are used as the target values.

Note that in this embodiment, pre-switch data acquisition is not performed when the image displayed prior to the switch is an external input image (in other words, when the displayed image is not switched). However, the present invention is not limited to this configuration, and the measurement results of the internal patch image may be obtained as the pre-switch data regardless of the image displayed prior to the switch. Further, when the image displayed prior to the switch is an external input image, the output setting of the external apparatus and the external input image parameter are likely to be set as desired, and therefore the comparison processing (determination processing) of FIG. 17 need not be performed.

Figure 18:
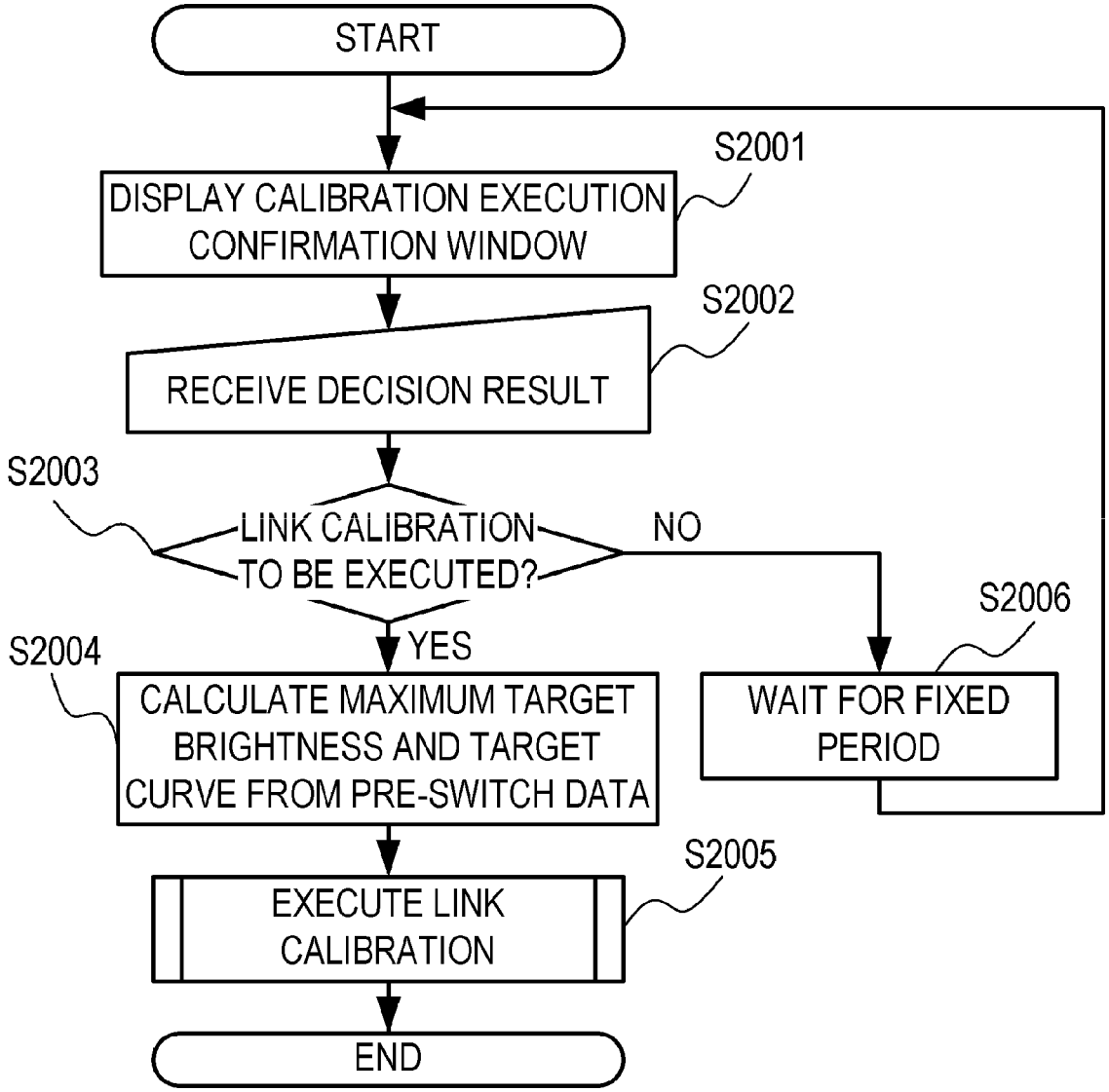
FIG. 18 shows an example of a flow of a non-normal link calibration according to the second embodiment.

FIG. 18 is a flowchart showing an example of a flow of processing (the non-normal link calibration) executed by the calibration execution control unit 303 upon reception of the link calibration execution request signal from the display comparison unit 311.

First, the calibration execution control unit 303 issues a request to the UI unit 301 to display the link calibration execution confirmation window (S2001).

Next, the calibration execution control unit 303 receives the result of the decision made by the user as to whether or not to execute the link calibration from the UI unit 301 (S2002).

When the user decides to execute the link calibration (S2003: YES), the calibration execution control unit 303 calculates the maximum target brightness value and the target curve from the pre-switch data (S2004). The calibration execution control unit 303 then executes the link calibration shown in FIG. 9 using the calculated maximum target brightness and the target curve (S2005).

When the user decides not to execute the link calibration (S2003: NO), the calibration execution control unit 303 waits for a fixed time (S2006), whereupon the processing returns to S2001.

According to this embodiment, as described above, the measurement values of the internal patch image measured by the brightness/chromaticity sensor 210 during display of the internal patch image stored in advance in the display apparatus at the single unit display image parameter are used as the target values. Since the target values of the link calibration and the single unit calibration are identical, the results of the single unit calibration can be used as the target values. Hence, according to this embodiment, effects corresponding to the effects of the first embodiment can be obtained.

Note that in this embodiment, the measurement results of the internal patch image are obtained when the displayed image is switched from a single unit display image to an external input image. However, the present invention is not limited to this configuration, and the measurement results of the internal patch image may be obtained during execution of a previous single unit calibration (during execution of the most recent single unit calibration), for example. Alternatively, the measurement results of the internal patch image may be obtained periodically.

Third Embodiment

In an example described in this embodiment, the determination as to whether or not the second display setting (the external input image parameter) differs from the setting during display of the previous external input image is made on the basis of an execution time and date of a past single unit calibration and an execution time and date of a past link calibration. In other words, an example in which the determination as to whether or not to execute the link calibration is made on the basis of the execution time and date of a past single unit calibration and the execution time and date of a past link calibration will be described. Note that description of parts that are identical to the first and second embodiments has been omitted.

Figure 19A:
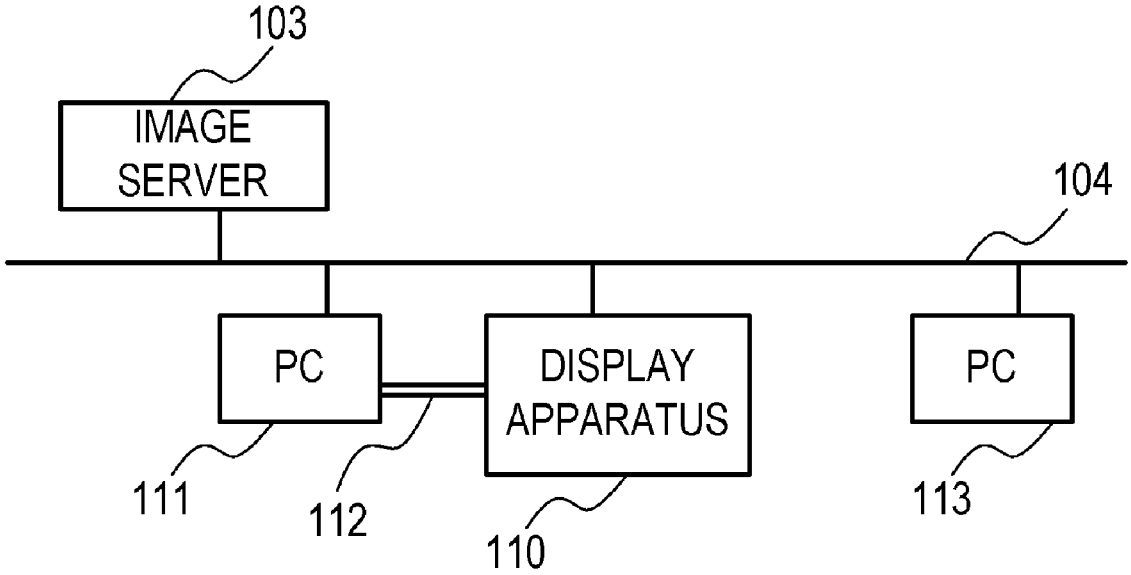
FIGS. 19A and 19B show examples of a display system according to a third embodiment.
Figure 19B:
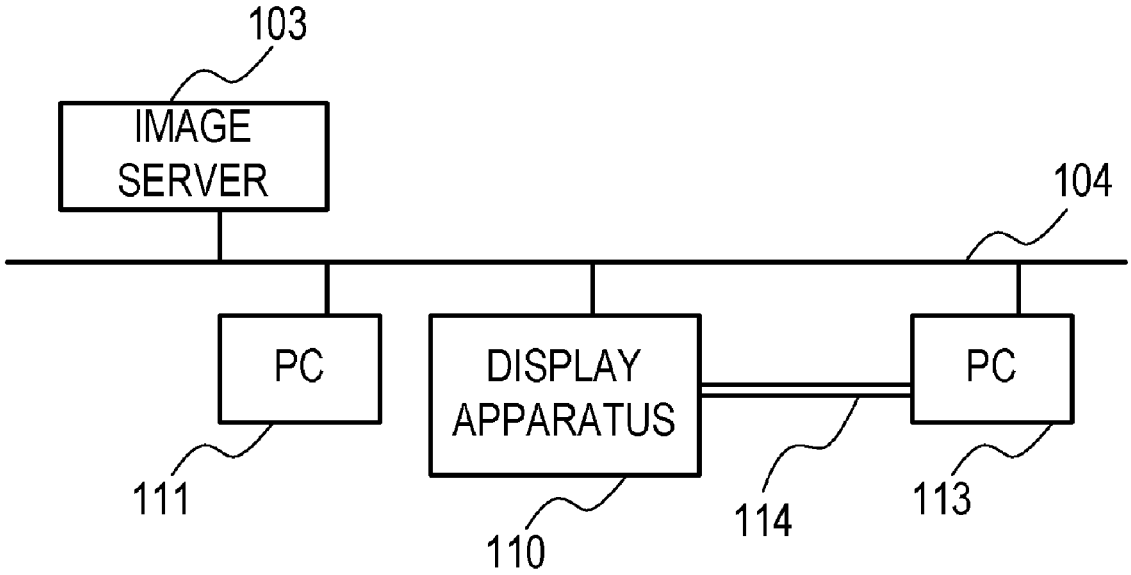

FIGS. 19A and 19B are views showing examples of a display system according to a third embodiment of the present invention. As described above, the external apparatus (PC) connected to the display apparatus can be changed (switched). In an example shown in FIG. 19A, a PC 111 is connected to a display apparatus 110 using an image cable 112. In an example shown in FIG. 19B, the display apparatus 110 and the PC 111 are not connected, and instead, a PC 113 is connected to the display apparatus 110 using an image cable 114. The display apparatus 110 obtains PC identification information from the PCs 111, 113 via the image cables 112, 114. The PC identification information is information for identifying the connected PC. The PC identification information of the PCs 111, 113 is a value set in advance by the user in the PCs 111, 113, for example.

Figure 20:
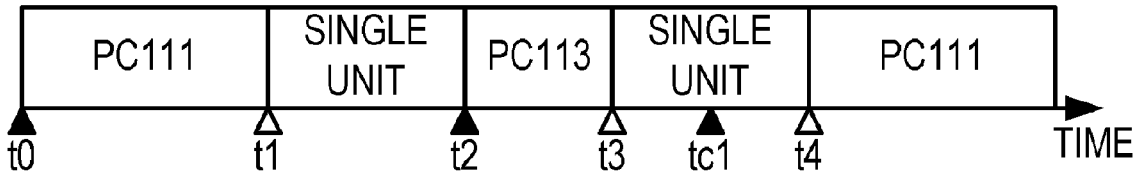
FIG. 20 shows an example of a relationship between a connected PC and time, according to the third embodiment.

FIG. 20 is a view showing an example of a relationship between the external apparatus (PC) connected to the display apparatus 110 and time. In the example shown in FIG. 20, the PC 111 is connected to the display apparatus 110 from a time t0 to a time t1 and from a time t4 onward, while the PC 113 is connected to the display apparatus 110 between a time t2 and a time t3. From the time t1 to the time t2 and from the time t3 to the time t4, a PC is not connected to the display apparatus 110, and therefore the display apparatus 110 operates alone. Note that black triangles in FIG. 20 represent times at which the normal calibration is executed. In other words, in the example shown in FIG. 20, both the single unit calibration and the link calibration are executed at the time t0 when the PC 111 is connected to the display apparatus 110 and the time t2 when the PC 113 is connected to the display apparatus 110. Further, the single unit calibration is executed at a time tc1 when a PC is not connected to the display apparatus 110.

Figure 21:
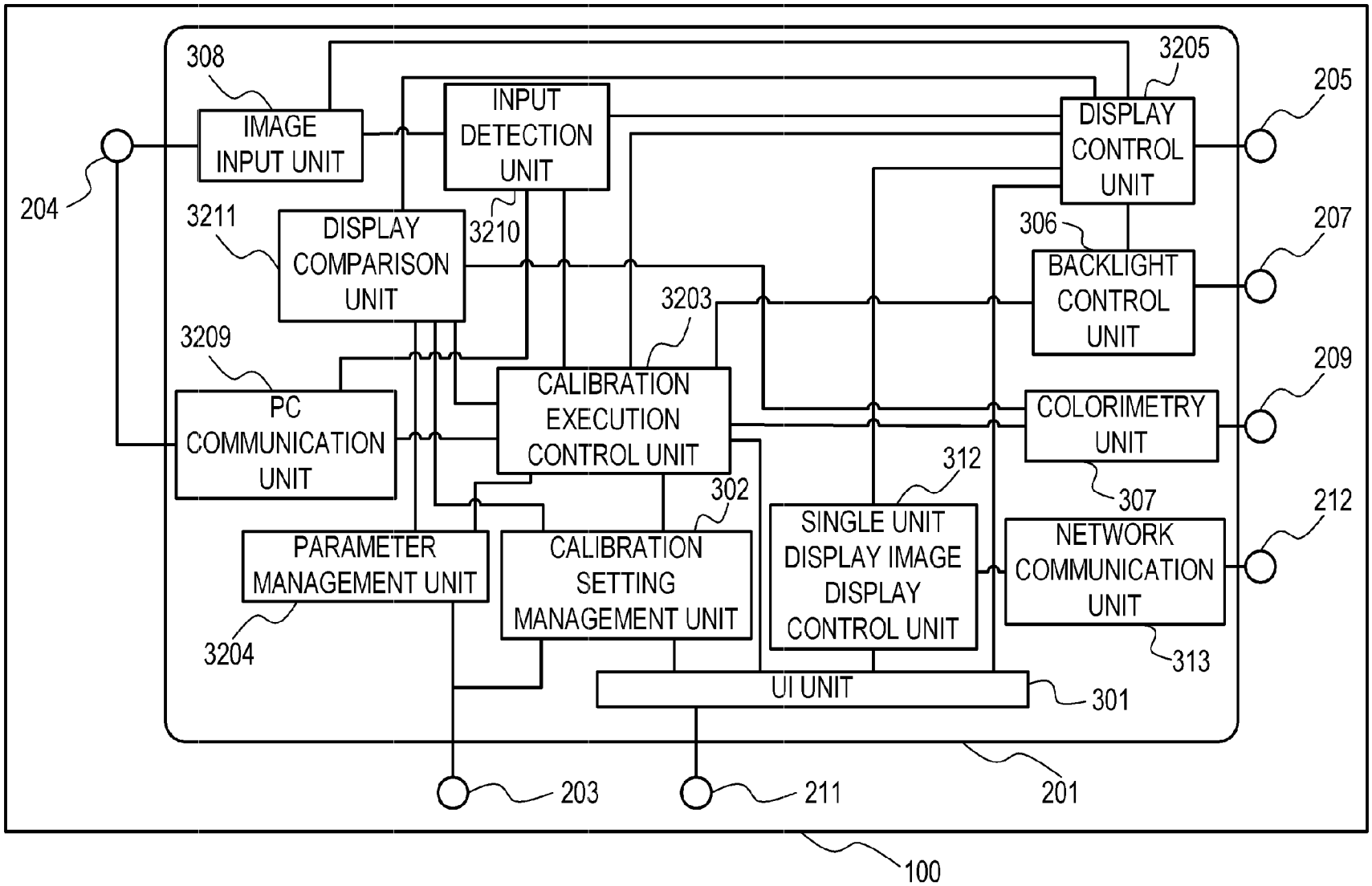
FIG. 21 shows an example of a functional configuration of a display apparatus according to the third embodiment.

FIG. 21 is a functional block diagram of the display apparatus 110 according to this embodiment.

A calibration execution control unit 3203 executes the link calibration and determines the second display setting (the external input image parameter) for each external apparatus.

More specifically, the calibration execution control unit 3203 obtains the PC identification information from the connected PC (the PC 111 or the PC 113) via a PC communication unit 3209 during execution of the link calibration. After executing the link calibration, the calibration execution control unit 3203 outputs the obtained PC identification information to a parameter management unit 3204 together with the determined external input image parameter.

All other functions of the calibration execution control unit 3203 are identical to the functions of the calibration execution control unit 303 shown in FIG. 3.

The parameter management unit 3204 writes the input external input image parameter to the nonvolatile memory 203 in association with the PC identification information input together therewith. Further, when writing the single unit display image parameter to the nonvolatile memory 203, the parameter management unit 3204 writes a write time thereof to the nonvolatile memory 203 as the execution time and date of the single unit calibration, and when writing the external input image parameter to the nonvolatile memory 203, the parameter management unit 3204 writes a write time thereof to the nonvolatile memory 203 as the execution time and date of the link calibration. In other words, the nonvolatile memory 203 stores the execution times and dates of past single unit calibrations and the execution times and dates of past link calibrations. Moreover, with regard to the link calibration, the execution times and dates of past link calibrations are stored for each external apparatus. All other functions of the parameter management unit 3204 are identical to the functions of the parameter management unit 304 shown in FIG. 3.

A display control unit 3205 obtains the PC identification information via the PC communication unit 3209 and an input detection unit 3210 when the external input image is selected. The display control unit 3205 then outputs an image quality adjustment parameter switch instruction to the image processing circuit 205 so that the image quality adjustment parameter corresponding to the PC identification information is used. Further, the display control unit 3205 outputs a backlight emission parameter switch instruction to the backlight control unit 306 so that the backlight emission parameter corresponding to the PC identification information is used in a display comparison unit 3211. Furthermore, the display control unit 3205 outputs the PC identification information to the display comparison unit 3211 together with the display comparison request signal. All other functions of the display control unit 3205 are identical to the functions of the display control unit 305 shown in FIG. 3.

The PC communication unit 3209 outputs a PC identification information acquisition request signal to the external apparatus (the PC 111 or the PC 113) via the image input circuit 204 in response to a request from the calibration execution control unit 3203 or the input detection unit 3210. Upon reception of the PC identification information acquisition request signal, the external apparatus outputs its own PC identification information as a response signal. The PC communication unit 3209 obtains the PC identification information from the PC 111 or the PC 113 via the image input circuit 204, and outputs the obtained PC identification information to the calibration execution control unit 3203 or the input detection unit 3210 (the transmission source of the request).

After receiving the input detection signal from the image input unit 308, the input detection unit 3210 obtains the PC identification information via the PC communication unit 3209 and stores the obtained information. All other functions of the input detection unit 3210 are identical to the functions of the input detection unit 310 shown in FIG. 3.

After receiving the display comparison request signal and the PC identification information from the display control unit 3205, the display comparison unit 3211 obtains the execution time and date of the single unit calibration and the execution time and date of the link calibration from the parameter management unit 3204 and compares the respective times and dates. A determination is then made from the comparison as to whether or not a difference exists between the external input image parameter and the setting during display of the previous external input image, and when it is determined that a difference exists, execution of the link calibration is determined to be required. Having determined that execution of the link calibration is required, the display comparison unit 3211 issues a request to the calibration execution control unit 3203 to execute the link calibration.

Determination processing executed by the display comparison unit 3211 will be described in detail below.

Figure 22:
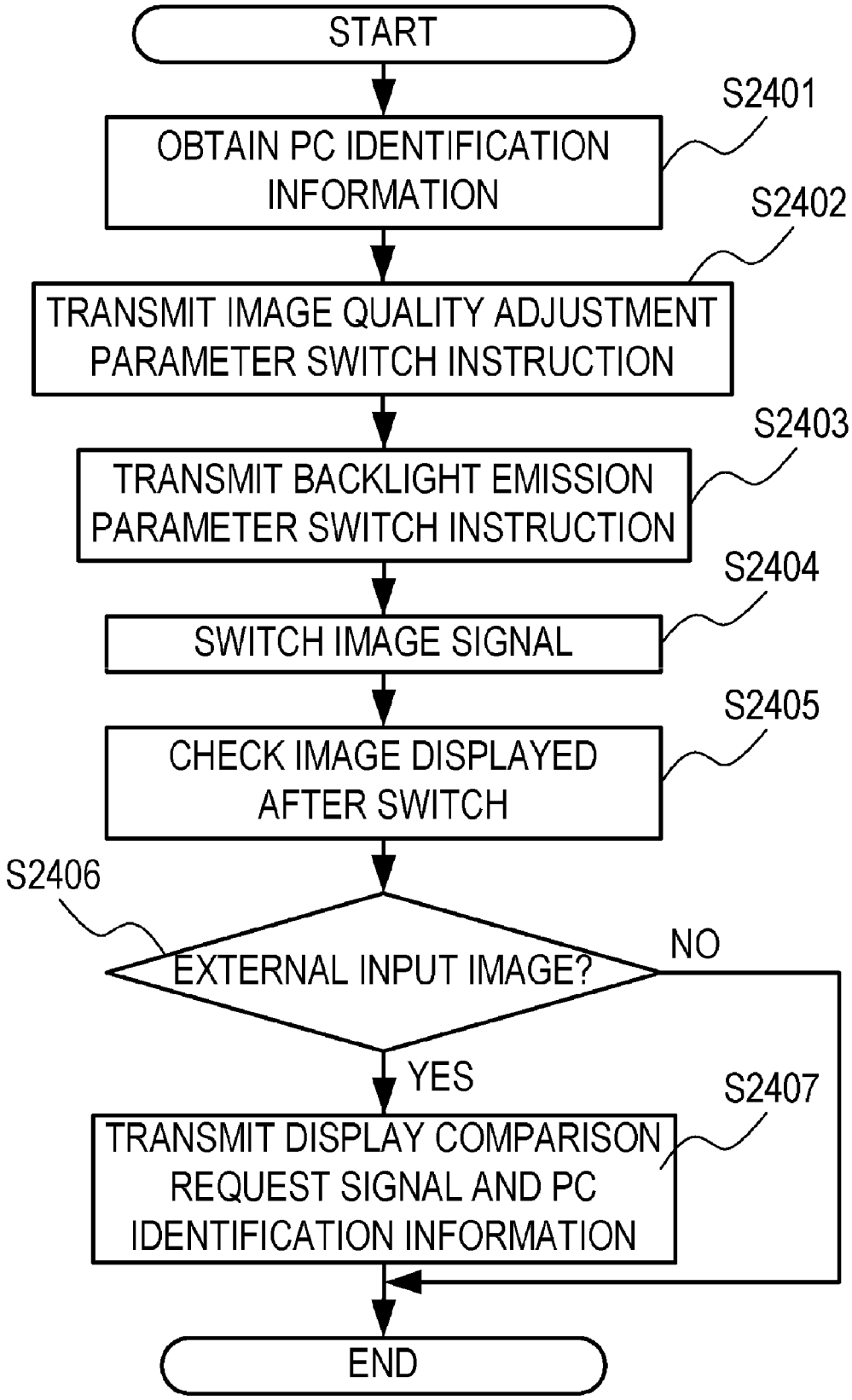
FIG. 22 shows an example of a flow of selection signal switching processing according to the third embodiment.

FIG. 22 is a flowchart showing an example of a flow of processing (selection signal switching processing) executed by the display control unit 3205 upon reception of the switch request signal from the UI unit 301 in response to a user operation.

First, the display control unit 3205 obtains the PC identification information from the input detection unit 3210 (S2401).

Next, the display control unit 3205 transmits the image quality adjustment parameter switch instruction to the image processing circuit 205 to switch the used image quality adjustment parameter to an image quality adjustment parameter corresponding to a post-display switch image signal (S2402). More specifically, when the post-display switch image signal is an external input image signal, the display control unit 3205 identifies the PC serving as the output source of the external input image signal from the PC identification information obtained in S2401. When the post-display switch image signal is an external input image signal from the PC 113, for example, the display control unit 3205 transmits the image quality adjustment parameter switch instruction so that the image quality adjustment parameter for the external input image signal input from the PC 113 is used. Further, when the post-display switch image signal is a single unit display image signal, the display control unit 3205 transmits the image quality adjustment parameter switch instruction so that the image quality adjustment parameter for a single unit display image signal is used.

The display control unit 3205 then transmits the backlight emission parameter switch instruction to the backlight control unit 306 to switch the used parameter to the backlight emission parameter corresponding to the post-display switch image signal (S2403).

Next, the display control unit 3205 switches the image signal to be output on the basis of the switch request signal (S2404).

The display control unit 3205 then determines on the basis of the switch request signal whether the image displayed after the switch is a single unit display image or an external input image (S2405).

When the image displayed after the switch is an external input image (S2406: YES), the display control unit 3205 transmits the display comparison request signal and the PC identification information obtained in S2401 to the display comparison unit 3211 (S2407).

When the image displayed after the switch is a single unit display image (S2406: NO), the display control unit 3205 terminates the processing as is.

Figure 23:
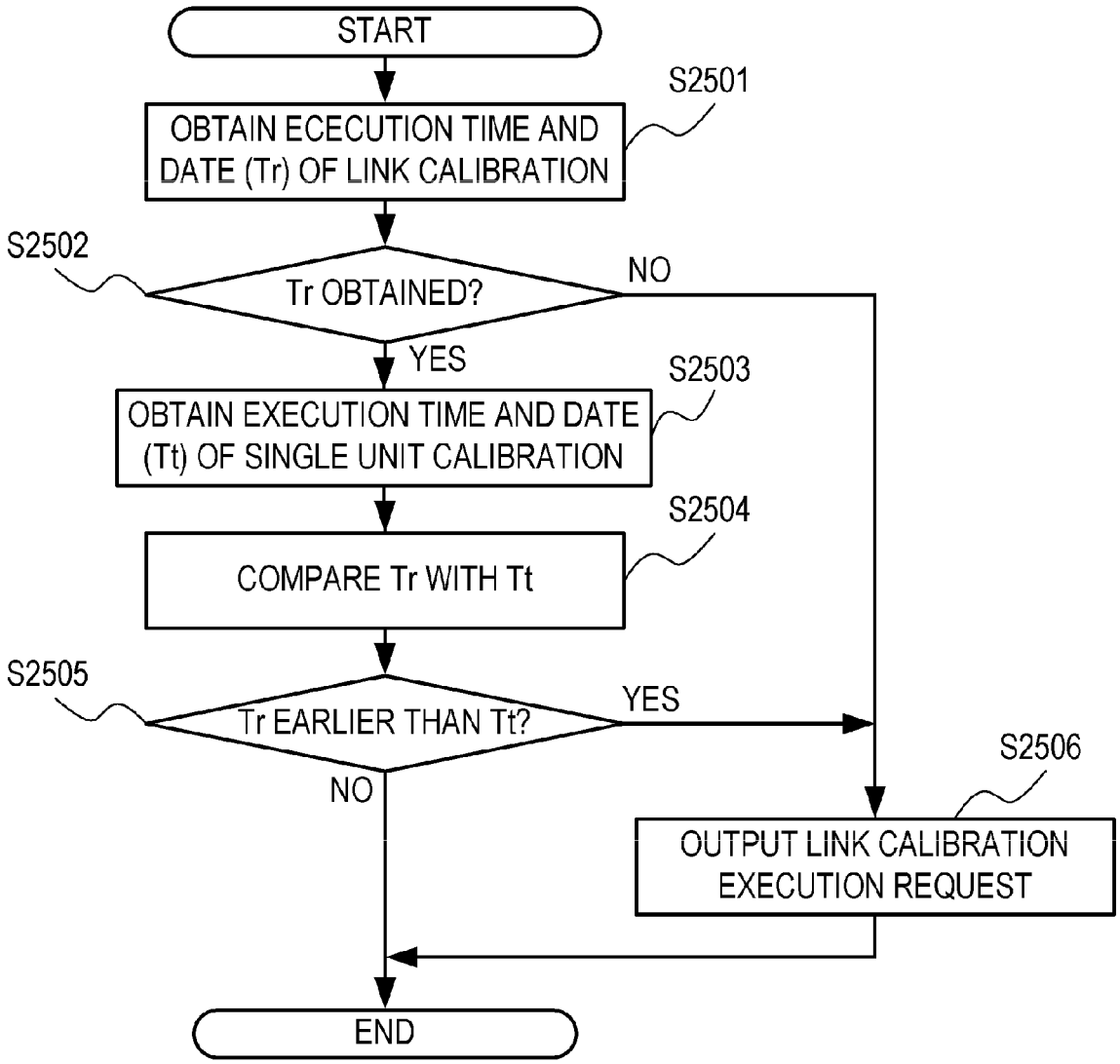
FIG. 23 shows an example of a flow of comparison processing executed by a display comparison unit according to the third embodiment.

FIG. 23 is a flowchart showing an example of a flow of processing (comparison processing) executed by the display comparison unit 3211 upon reception of the display comparison request signal and the PC identification information from the display control unit 3205.

First, the display comparison unit 3211 obtains an execution time and date (Tr) of the link calibration corresponding to the PC identification information from the parameter management unit 3204 (S2501).

When it is possible to obtain the execution time and date of the link calibration (S2502: YES), the processing advances to S2503.

When it is not possible to obtain the execution time and date of the link calibration (S2502: NO), this means that the link calibration has not yet been performed (in relation to the PC identified by the PC identification information). It is therefore highly likely that the external input image parameter desired by the user has not been set. In this embodiment, the display comparison unit 3211 determines in such cases that a difference exists between the external input image parameter and the setting during display of the previous external input image. Accordingly, the display comparison unit 3211 determines that execution of the link calibration is required, and outputs the link calibration execution request signal to the calibration execution control unit 3203 (S2506).

In S2503, the display comparison unit 3211 obtains an execution time and date (Tt) of the single unit calibration from the parameter management unit 3204.

The display comparison unit 3211 then compares the execution time and date of the link calibration obtained in S2501 with the execution time and date of the single unit calibration obtained in S2503 (S2504). A determination is then made from the comparison as to whether or not a difference exists between the external input image parameter (specifically, the parameter desired by the user) and the setting during display of the previous external input image.

When the execution time and date of the link calibration is earlier than the execution time and date of the single unit calibration (S2505: YES), it is highly likely that the external input image parameter desired by the user is different to the previous setting. In this embodiment, the display comparison unit 3211 determines in such cases that a difference exists between the external input image parameter and the setting during display of the previous external input image. Accordingly, the display comparison unit 3211 determines that execution of the link calibration is required, and outputs the link calibration execution request signal to the calibration execution control unit 3203 (S2506).

When the execution time and date of the link calibration is not earlier than the execution time and date of the single unit calibration (S2505: NO), the display comparison unit 3211 determines that the external input image parameter and the setting during display of the previous external input image are identical, and terminates the processing as is.

Hence, according to this embodiment, the external input image parameter is determined to be different to the setting during display of the previous external input image when an external input image based on an image signal input from the external apparatus is displayed and the link calibration has not been executed in relation to the external apparatus in the past. Further, the external input image parameter is determined to be different to the setting during display of the previous external input image when the most recent execution time and date of the link calibration is earlier than the most recent execution time and date of the single unit calibration.

At the time t4 in FIG. 20, the execution time of the link calibration corresponding to the PC 111 is the time t0, while the execution time of the single unit calibration is the time tc1 (which is earlier than the time t0). Therefore, on the basis of the flowchart shown in FIG. 23, the display comparison unit 3211 outputs the link calibration execution request signal to the calibration execution control unit 3203.

According to this embodiment, as described above, it is possible to determine whether or not a difference exists between the second display setting and the setting during display of the previous external input image using a simple method of comparing the execution time of the single unit calibration with the execution time of the link calibration. As a result, a screen measurement (measurement of the brightness and the chromaticity) such as that performed in the methods of the first and second embodiments is not required, and therefore a processing load can be lightened.

Note that in this embodiment, the execution time and date of the link calibration is stored for each PC, but the execution time and date of the link calibration may be stored without differentiating between the PCs. When the most recent execution time and date of the link calibration is earlier than the most recent execution time and date of the single unit calibration, it is highly likely that the second display setting desired by the user is different to the setting during display of the previous external input image. In such cases, therefore, a difference may be determined to exist between the second display setting and the setting during display of the previous external input image regardless of whether or not the most recent link calibration was executed in relation to the currently connected external apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-156564, filed on Jul. 15, 2011, which is hereby incorporated by reference herein in its entirety.

What is claimed is:

1. A display apparatus comprising:

a measuring unit that measures an image displayed on a screen;

a first determining unit that determines a first display setting by executing a single unit calibration in which a pre-stored first calibration image is displayed and a display setting is adjusted such that a measurement value of the first calibration image measured by the measuring unit approaches a target value;

a second determining unit that determines a second display setting by executing a link calibration in which a second calibration image based on a calibration image signal input from an external apparatus is displayed and the display setting is adjusted such that a measurement value of the second calibration image measured by the measuring unit approaches the target value; and a third determining unit that executes, in a case where an external input image, which is an image based on an image signal input from the external apparatus, is displayed, a determination whether or not an output setting of the external apparatus or a second display setting differs from a setting during display of a previous external input image which is an image based on a previous external input image signal, wherein in a case where the external input image is displayed, the second calibration image is displayed at a second display setting, the third determining unit determines that the output setting of the external apparatus or the second display setting differs from the setting during display of the previous external input image in a case where a difference between the measurement value of the second calibration image measured by the measuring unit and the target value is greater than a predetermined threshold, and the second determining unit executes the link calibration in a case where the third determining unit determines that the output setting of the external apparatus or the second display setting differs from the setting during display of the previous external input image.

2. The display apparatus according to claim 1, further comprising a detecting unit that detects an input of an image signal from the external apparatus, wherein the first determining unit executes the single unit calibration in a case where a user operation to indicate an execution of a calibration is performed, in a case where the user operation is performed and the input of the image signal from the external apparatus is detected by the detecting unit, the second determining unit executes the link calibration, and in a case where the user operation is performed and the input of the image signal from the external apparatus is not detected by the detecting unit, the second determining unit omits an execution of the link calibration.

3. The display apparatus according to claim 1, wherein the second determining unit acquires a detection result of the detecting unit in response to completion of the single unit calibration.

4. The display apparatus according to claim 1, wherein the third determining unit executes the determination in response to a user operation to change a display target image to the external input image.

5. The display apparatus according to claim 1, wherein the first calibration image is decoded by the display apparatus, and the second calibration image is decoded by the external apparatus.

6. A display apparatus comprising:

a measuring unit that measures an image displayed on a screen;

a first determining unit that determines a first display setting by executing a single unit calibration in which a pre-stored first calibration image is displayed and a display setting is adjusted such that a measurement value of the first calibration image measured by the measuring unit approaches a target value;

a second determining unit that determines a second display setting by executing a link calibration in which a second calibration image based on a calibration image signal input from an external apparatus is displayed and the display setting is adjusted such that a measurement value of the second calibration image measured by the measuring unit approaches the target value; and a third determining unit that executes, in a case where an external input image, which is an image based on an image signal input from the external apparatus, is displayed, a determination whether or not an output setting of the external apparatus or a second display setting differs from a setting during display of a previous external input image which is an image based on a previous external input image signal, wherein in a case where the external input image is displayed, the second calibration image is displayed at the second display setting, the third determining unit determines that the output setting of the external apparatus or the second display setting differs from the setting during display of the previous external input image in a case where a difference between the measurement value of the second calibration image and the measurement value of the first calibration image displayed at the first display setting is greater than a predetermined threshold, and the second determining unit executes the link calibration in a case where the third determining unit determines that the output setting of the external apparatus or the second display setting differs from the setting during display of the previous external input image.

7. The display apparatus according to claim 6, further comprising a detecting unit that detects an input of an image signal from the external apparatus, wherein the first determining unit executes the single unit calibration in a case where a user operation to indicate an execution of a calibration is performed, in a case where the user operation is performed and the input of the image signal from the external apparatus is detected by the detecting unit, the second determining unit executes the link calibration, and in a case where the user operation is performed and the input of the image signal from the external apparatus is not detected by the detecting unit, the second determining unit omits an execution of the link calibration.

8. The display apparatus according to claim 6, wherein the second determining unit acquires a detection result of the detecting unit in response to completion of the single unit calibration.

9. The display apparatus according to claim 6, wherein the third determining unit executes the determination in response to a user operation to change a display target image to the external input image.

10. The display apparatus according to claim 6, wherein the first calibration image is decoded by the display apparatus, and the second calibration image is decoded by the external apparatus.

11. A display apparatus comprising:

a measuring unit that measures an image displayed on a screen;

a first determining unit that determines a first display setting by executing a single unit calibration in which a pre-stored first calibration image is displayed and a display setting is adjusted such that a measurement value of the first calibration image measured by the measuring unit approaches a target value;

a second determining unit that determines a second display setting by executing a link calibration in which a second calibration image based on a calibration image signal input from an external apparatus is displayed and the display setting is adjusted such that a measurement value of the second calibration image measured by the measuring unit approaches the target value;

a third determining unit that executes, in a case where an external input image, which is an image based on an image signal input from the external apparatus, is displayed, determination whether or not an output setting of the external apparatus or a second display setting differs from a setting during display of a previous external input image which is an image based on a previous external input image signal; and a storage unit that stores past execution times and dates of the single unit calibration and past execution times and dates of the link calibration, wherein the third determining unit determines that the second display setting differs from the setting during display of the previous external input image in a case where a most recent execution time and date of the link calibration is earlier than a most recent execution time and date of the single unit calibration, and the second determining unit executes the link calibration in a case where the third determining unit determines that the output setting of the second display setting differs from the setting during display of the previous external input image.

12. The display apparatus according to claim 11, wherein the external apparatus that outputs the image signal to the display apparatus can be changed, the second determining unit executes the link calibration and determines the second display setting for each external apparatus, the storage unit stores the past execution times and dates of the link calibration for each external apparatus, and the third determining unit determines that the second display setting differs from the setting during display of the previous external input image of the external apparatus in a case where the link calibration has not been executed in relation to the external apparatus in the past or the most recent execution time and date of the link calibration is earlier than the most recent execution time and date of the single unit calibration.

13. The display apparatus according to claim 11, further comprising a detecting unit that detects an input of an image signal from the external apparatus, wherein the first determining unit executes the single unit calibration in a case where a user operation to indicate an execution of a calibration is performed, in a case where the user operation is performed and the input of the image signal from the external apparatus is detected by the detecting unit, the second determining unit executes the link calibration, and in a case where the user operation is performed and the input of the image signal from the external apparatus is not detected by the detecting unit, the second determining unit omits an execution of the link calibration.

14. The display apparatus according to claim 11, wherein the second determining unit acquires a detection result of the detecting unit in response to completion of the single unit calibration.

15. The display apparatus according to claim 11, wherein the third determining unit executes the determination in response to a user operation to change a display target image to the external input image.

16. The display apparatus according to claim 11, wherein the first calibration image is decoded by the display apparatus, and the second calibration image is decoded by the external apparatus.

17. A display apparatus control method comprising:

a measuring step of measuring an image displayed on a screen;

a first determining step of determining a first display setting by executing a single unit calibration in which a pre-stored first calibration image is displayed and a display setting is adjusted such that a measurement value of the first calibration image measured in the measuring step approaches a target value;

a second determining step of determining a second display setting by executing a link calibration in which a second calibration image based on a calibration image signal input from an external apparatus is displayed and the display setting is adjusted such that a measurement value of the second calibration image measured in the measuring step approaches the target value; and a third determining step of executing, in a case where an external input image, which is an image based on an image signal input from the external apparatus, is displayed, a determination whether or not an output setting of the external apparatus or a second display setting differs from a setting during display of a previous external input image which is an image based on a previous external input image signal, wherein in a case where the external input image is displayed, the second calibration image is displayed at the second display setting, the output setting of the external apparatus or the second display setting is determined in the third determining step to differ from the setting during display of the previous external input image in a case where a difference between the measurement value of the second calibration image measured in the measuring step and the target value is greater than a predetermined threshold, and the link calibration is executed in the second determining step in a case where the output setting of the external apparatus or the second display setting is determined in the third determining step to differ from the setting during display of the previous external input image.

18. A display apparatus control method comprising:

a measuring step of measuring an image displayed on a screen;

a first determining step of determining a first display setting by executing a single unit calibration in which a pre-stored first calibration image is displayed and a display setting is adjusted such that a measurement value of the first calibration image measured in the measuring step approaches a target value;

a second determining step of determining a second display setting by executing a link calibration in which a second calibration image based on a calibration image signal input from an external apparatus is displayed and the display setting is adjusted such that a measurement value of the second calibration image measured in the measuring step approaches the target value; and a third determining step of executing, in a case where an external input image, which is an image based on an image signal input from the external apparatus, is displayed, a determination whether or not an output setting of the external apparatus or a second display setting differs from a setting during display of a previous external input image which is an image based on a previous external input image signal, wherein in a case where the external input image is displayed, the second calibration image is displayed at the second display setting, the output setting of the external apparatus or the second display setting is determined in the third determining step to differ from the setting during display of the previous external input image in a case where a difference between the measurement value of the second calibration image and the measurement value of the first calibration image displayed at the first display setting is greater than a predetermined threshold, and the link calibration is executed in the second determining step in a case where the output setting of the external apparatus or the second display setting is determined in the third determining step to differ from the setting during display of the previous external input image.

19. A display apparatus control method comprising:

a measuring step of measuring an image displayed on a screen;

a first determining step of determining a first display setting by executing a single unit calibration in which a pre-stored first calibration image is displayed and a display setting is adjusted such that a measurement value of the first calibration image measured in the measuring step approaches a target value;

a second determining step of determining a second display setting by executing a link calibration in which a second calibration image based on a calibration image signal input from an external apparatus is displayed and the display setting is adjusted such that a measurement value of the second calibration image measured in the measuring step approaches the target value;

a third determining step of executing, in a case where an external input image, which is an image based on an image signal input from the external apparatus, is displayed, determination whether or not an output setting of the external apparatus or a second display setting differs from a setting during display of a previous external input image which is an image based on a previous external input image signal; and a storage step of storing past execution times and dates of the single unit calibration and past execution times and dates of the link calibration, wherein the second display setting is determined in the third determining step to differ from the setting during display of the previous external input image in a case where a most recent execution time and date of the link calibration is earlier than a most recent execution time and date of the single unit calibration, and the link calibration is executed in the second determining step in a case where the output setting of the second display setting is determined in the third determining step to differ from the setting during display of the previous external input image.

20. The display apparatus control method according to claim 19, wherein the external apparatus that outputs the image signal to the display apparatus can be changed, execution of the link calibration and determination of the second display setting is performed for each external apparatus in the second determining step, the past execution times and dates of the link calibration are stored for each external apparatus in the storage step, and the second display setting is determined in the third determining step to differ from the setting during display of the previous external input image of the external apparatus in a case where the link calibration has not been executed in relation to the external apparatus in the past or the most recent execution time and date of the link calibration is earlier than the most recent execution time and date of the single unit calibration.

* * * * *